US009624004B2

(12) United States Patent
Kent et al.

(10) Patent No.: US 9,624,004 B2
(45) **Date of Patent: *Apr. 18, 2017**

(54) BAG

(71) Applicant: The Glad Products Company, Oakland, CA (US)

(72) Inventors: Gregory S. Kent, Plainfield, IL (US); Matthew W. Waldron, West Chester, OH (US); Shaun T. Broering, Fort Thomas, KY (US); David Hoying, Cincinnati, OH (US); John Schroeder, Mason, OH (US)

(73) Assignee: The Glad Products Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/926,463

(22) Filed: Oct. 29, 2015

(65) Prior Publication Data

US 2016/0046412 A1 Feb. 18, 2016

Related U.S. Application Data

(63) Continuation of application No. 12/545,484, filed on Aug. 21, 2009.

(Continued)

(51) Int. Cl.
*B65D 33/28* (2006.01)
*B65F 1/00* (2006.01)

(52) U.S. Cl.
CPC ..... *B65D 33/28* (2013.01); *B65F 1/0006* (2013.01)

(58) Field of Classification Search
CPC ..... B29C 51/04
See application file for complete search history.

(56) References Cited

U.S. PATENT DOCUMENTS 3,491,185 A 1/1970 Rasmussen
3,738,567 A 6/1973 Ruda (Continued)

FOREIGN PATENT DOCUMENTS

WO WO00/56635 9/2000
WO WO2004/096535 11/2004
WO WO2007/146877 12/2007

OTHER PUBLICATIONS

International Search Report, mailed Jun. 28, 2010, from counterpart PCT/US2010/033365.

(Continued)

*Primary Examiner* — Jes F Pascua
*Assistant Examiner* — Nina Attel
(74) *Attorney, Agent, or Firm* — Thomas C. Feix

(57) ABSTRACT

The bag may include a draw tape that may be used to cinch closed the opening of the bag. The draw tape may include an elastic characteristic and may be smaller in size than the peripheral distance about the opening. The draw tape in its natural contracted state may partially constrict the opening. However, the draw tape may be stretched or expanded to enable a user to dilate the opening and fold the periphery of the opening over the rim of the canister. The draw tape may then recover or constrict to grip about the rim of the receptacle to hold the bag to the canister. In one embodiment, the bag may include a pattern proximate the bag opening to allow the bag opening to be stretched over the rim of the canister.

20 Claims, 32 Drawing Sheets

Related U.S. Application Data

(60) Provisional application No. 61/091,679, filed on Aug. 25, 2008.

(56) References Cited

U.S. PATENT DOCUMENTS 3,795,338 A 3/1974 Swartzbaugh et al.
4,401,427 A 8/1983 Benoit et al.
4,598,833 A 7/1986 Herr
4,628,536 A 12/1986 Herrington
4,650,451 A 3/1987 Herrington
4,726,483 A 2/1988 Drozd
4,762,430 A 8/1988 Bullard
4,802,582 A 2/1989 Johnson
4,842,421 A 6/1989 Bullard et al.
5,133,607 A 7/1992 Bonke
5,205,650 A 4/1993 Rasmussen
5,232,118 A 8/1993 Samuel
5,235,118 A 8/1993 Morris et al.
5,390,875 A 2/1995 Gietman et al.
5,411,157 A 5/1995 King et al.
5,618,111 A 4/1997 Porchia et al.
5,716,137 A 2/1998 Meyer
5,749,484 A 5/1998 Trout
5,934,275 A * 8/1999 Gazzara ..... A41D 13/1115 128/205.27
6,059,458 A 5/2000 Belias et al.
6,186,662 B1 2/2001 Jackson
6,220,753 B1 4/2001 Metzger
6,394,651 B2 5/2002 Jackson
6,402,377 B1 6/2002 Vo et al.
6,695,476 B2 2/2004 Jackson et al.
6,939,042 B2 9/2005 Rusnak et al.
6,966,697 B2 11/2005 Patridge et al.
7,077,796 B2 7/2006 Rusnak et al.
7,946,765 B2 5/2011 Melvan et al.
2003/0072505 A1 4/2003 Pihl
2004/0086205 A1 5/2004 Raterman
2004/0097357 A1* 5/2004 Pihl ..... B65D 33/28 493/190
2004/0192529 A1 9/2004 Rusnak et al.
2004/0202388 A1 10/2004 Rusnak et al.
2005/0063622 A1 3/2005 Kannabiran
2005/0207681 A1 9/2005 Raterman
2005/0215964 A1 9/2005 Autran et al.
2006/0093766 A1* 5/2006 Savicki ..... B29C 59/04 428/35.2
2006/0204716 A1* 9/2006 Bonke ..... B65F 1/0006 428/123
2007/0036472 A1 2/2007 Persenda
2007/0102389 A1 5/2007 Hoepner et al.
2007/0144996 A1 6/2007 Sawyer
2008/0070994 A1* 3/2008 Li ..... D04H 1/4291 514/788.1
2008/0137995 A1 6/2008 Fraser et al.
2008/0245466 A1 10/2008 Schmal et al.
2010/0046860 A1 2/2010 Kent et al.
2010/0172602 A1* 7/2010 O'Donnell ..... B32B 27/32 383/75
2010/0272379 A1 10/2010 Hu

OTHER PUBLICATIONS

International Search Report, mailed Oct. 6, 2009, from counterpart PCT/US2009/054938.

* cited by examiner

BAG

CROSS REFERENCE TO RELATED APPLICATIONS

This application is a Continuation and claims the benefit of U.S. application Ser. No. 12/545,484, filed Aug. 21, 2009, which claims the benefit of U.S. Provisional Application No. 61/091,679, filed Aug. 25, 2008, both of which are hereby incorporated by reference in its entirety.

BACKGROUND

Among their many applications, it is known to use thermoplastic bags as liners in trash or refuse receptacles. Trash receptacles that employ such liners may be found at many locations, such as, from small household waste baskets and kitchen garbage cans. The trash canisters are typically made from a rigid material such as metal or plastic. Bags that are intended to be used as liners for such refuse containers are typically made from low-cost, pliable thermoplastic material. When the receptacle is full, the thermoplastic liner actually holding the trash can be removed for further disposal and replaced with a new liner. To avoid inadvertently spilling the contents during disposal, the bags may be provided with a draw tape that allows for constricting or closing the open circumference of the bag. The draw tape may also be tied into a knot to simplify handling of the bag during disposal.

When being utilized as a trash canister liner, it is important that the bag be secured in a manner that the bag may extend vertically within the canister so that items placed into the canister fall and collect at the bottom of the bag. Additionally, it is important that the bag does not unsecure or release itself with respect to the trash receptacle so as to fall into the trash receptacle. To avoid this problem, the open circumference of the bag is often folded over the lip or rim of the trash canister and may be tied thereto in order to retain the bag to the trash canister. However, tying knots into liner bags in order to secure them to the canister is an inconvenient and time consuming process. Moreover, tying knots into the liner bag may interfere with the draw tape, if provided.

Another potential difficulty is securing the bag to a canister which is larger than the bag mouth opening. If the canister is larger than the bag mouth opening, then the user cannot fold the bag over the rim of the canister.

Therefore, it is desirable to develop a simpler and quicker method of securing trash bag liners to trash canisters. It is also desirable to implement the securing method in such a manner that it is inexpensive and may be facilitated in a high speed manufacturing environment.

BRIEF SUMMARY

A thermoplastic bag usable as a trash receptacle liner includes a bag body defining an interior volume for receiving refuse and an opening disposed into the bag body for accessing the interior volume. A draw tape may be provided in a hem formed about the periphery of the opening for cinching closed the opening. The draw tape has a length when contracted that is less than the perimeter of the opening so as to partially constrict the periphery of the opening. However, to assist in securing the bag to a refuse canister, the draw tape may be stretched to dilate the opening when, for example, folding the opening about the rim of the trash receptacle. The draw tape may then contract or recover to grip about the perimeter of the receptacle and hold the bag thereto.

In an embodiment, the thermoplastic bag may be formed with a first sidewall and a second sidewall of pliable thermoplastic web material. The first and second sidewalls may be overlaid and joined to each other along a first side edge, a second side edge, and a closed bottom edge extending between the first and second side edges to delineate the interior volume. To provide the opening for accessing the interior volume, the top edges of the respective first and second sidewalls, located opposite the closed bottom edge, may remain un-joined. The draw tape may include an intermediate portion accommodated loosely within hems formed along the first and second un-joined top edges with the ends of the draw tape attached to the bag at the first and second side edges. The draw tape may be accessible and may be drawn through one or more notches disposed into the hems. The elastic characteristic allows the draw tape to expand and contract along its length within the hems. Because the size of the contracted draw tape may be less than the corresponding width of the opening defined between the first and second parallel side edges, the draw tape may cause the sidewall material at the un-joined top edges to gather or shin together. When the draw tape is stretched or expanded during, for instance, insertion of the bag into a refuse canister, the un-joined top edges may un-gather to accommodate the stretch.

In one embodiment, the draw tape may be made from thermoplastic that is pre-stretched prior to insertion into the hem. The stretched draw tape may demonstrate some amount of recovery that allows it to contract along its length. In another embodiment, the draw tape may be pre-stretched and may have a pattern including a plurality of linearly arranged and substantially parallel ribs along its length. In another embodiment, the pre-stretching and/or the pattern may be intermittent along the length of the draw tape.

In one embodiment, the bag may include a pattern proximate the opening. The pattern may allow the bag opening to be stretched to fit over the rim of a canister. The rim of the canister may be larger than the lower portion of the bag.

The thermoplastic bag may be produced in a high speed manufacturing process that develops continuous sheet-like webs of thermoplastic material into the finished bag via automated equipment. The process may form hems along an edge of the advancing web for accommodating the draw tape. The process may provide a strip of tape material in a stretched condition, insert the strip into the hem, and form the side seals in the stretched condition. The stretched strip may be relaxed after or during the manufacture of the rest of the bag.

An advantage is that the elastic characteristic of the draw tape enables the bag to better secure itself to a container and may resist falling into the canister. Another advantage of the thermoplastic bag is that it includes a draw tape that may be used to constrict the opening and reduce spillage of any contents. Another advantage is that the user may be able to stretch the bag opening to secure the bag to a canister which is larger than the bag mouth opening. A further possible advantage is that the thermoplastic bag may be produced by a high speed, low cost manufacturing process. These and other advantages and features of the thermoplastic bag will become apparent from the following description and accompanying drawings.

DESCRIPTION

Figure 1:
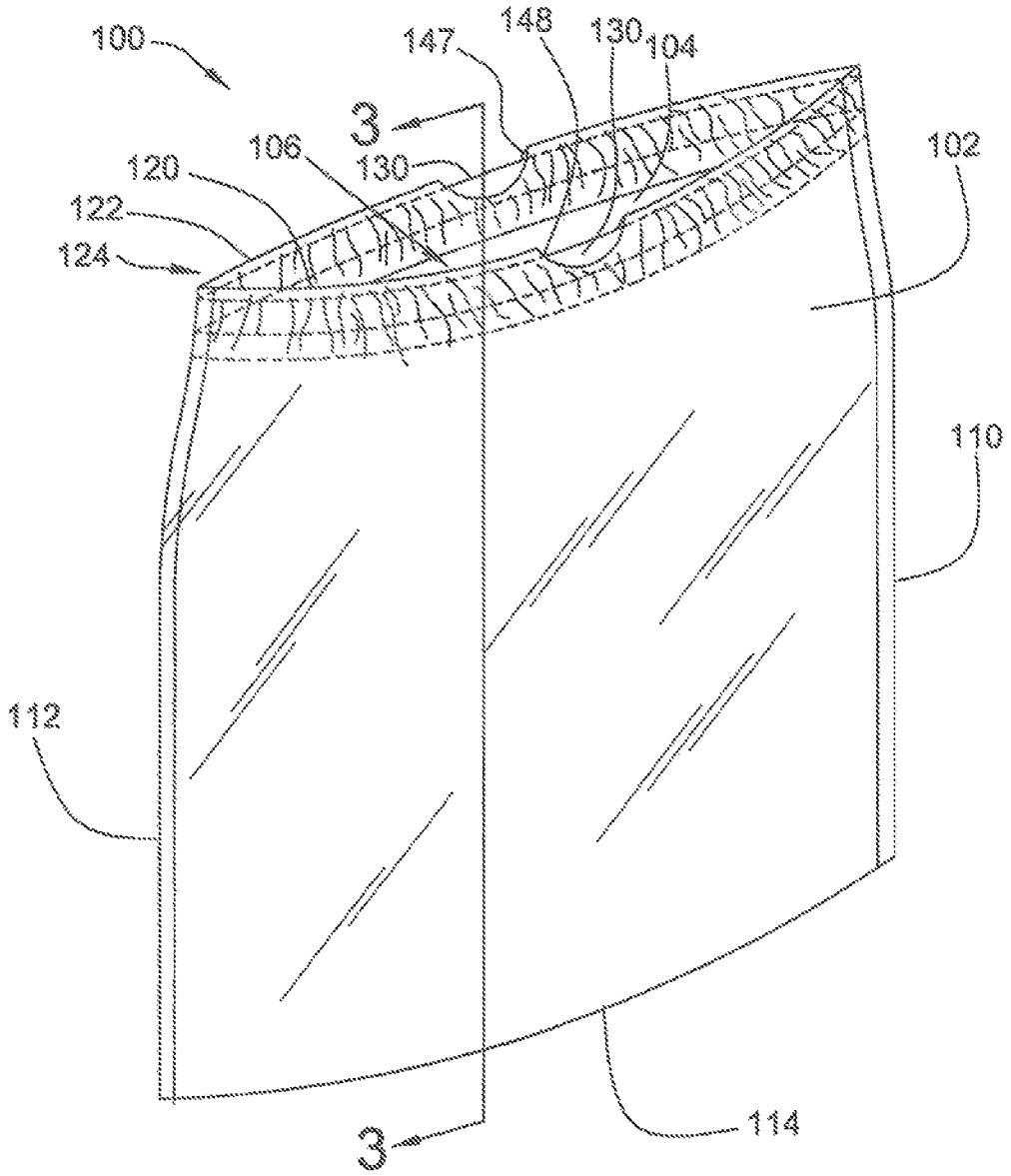
FIG. 1 is a perspective view of a thermoplastic bag having a draw tape in a contracted state that partially constricts the bag opening.

Referring to FIG. 1, there is illustrated a thermoplastic bag 100 of the kind useful as a liner for trash receptacles and refuse containers. Of course, the illustrated bag may have additional or different uses. The bag 100 may be made from a first sidewall 102 and opposing second sidewall 104 overlaid and joined to the first sidewall to define an interior volume 106 for holding trash. The first and second sidewalls may have matching rectangular or square shapes and may be joined along a first side edge 110, a second side edge 112 that may be parallel to and spaced apart from the first side edge, and a closed bottom edge 114 that extends between the first and second side edges. The sidewalls 102, 104 may be joined along their edges by any suitable joining process such as, for example, heat sealing in which the thermoplastic material bonds or melts together. Other sealing or joining processes may include ultrasonic methods and adhesive.

The first and second sidewalls 102, 104 may be made of flexible or pliable thermoplastic material formed or drawn into a smooth, thin-walled web or sheet. Examples of suitable thermoplastic materials may include polymers, for example, polyethylenes (such as, high density polyethylene, low density polyethylene, linear low density polyethylene, very low density polyethylene, ultra low density polyethylene), polypropylene, ethylene vinyl acetate, nylon, polyester, ethylene vinyl alcohol, ethylene-methyl acrylate, or polystyrene, and may be formed in combinations and in single or multiple layers. When used as a garbage can liner, the thermoplastic material will typically be opaque but could also be transparent, translucent, or tinted. Furthermore, the material used for the sidewalls may provide a fluid barrier, such as, a liquid barrier and/or a gas barrier and may include other features such as being treated with deodorants and/or disinfectants as is sometimes desirable in the production of trash can liners.

To access the interior volume 106, the top edges 120, 122 of the first and second sidewalls between the first and second side edges and which are located opposite the bottom edge 114 may remain un-joined to provide the periphery of an opening 124. When the bag 100 is placed in a trash receptacle, the top edges 120, 122 corresponding to the opening 124 are typically folded back over the rim to help retain the bag in a vertical position within the receptacle.

To close the opening 124 of the bag 100 when, for example, disposing of the trash receptacle liner, the bag may be fitted with a draw tape 130. To accommodate the draw tape 130, referring to FIG. 3, the top edges 120, 122 of the first and second sidewalls 102, 104 corresponding to the periphery of the opening 124 may include respective first and second hem flaps 140, 142. The first hem flap 140 may be folded back into the interior volume 106 and attached to the interior surface of the first sidewall 102 to form a first hem 144. Similarly, the second hem flap 142 of the second sidewall 104 is similarly folded back into the interior volume 106 and attached to the second sidewall to form a second hem 146. The hem flaps may be attached to the interior surfaces of the sidewalls by adhesive, heat seals or otherwise. In other embodiments, the hems may be formed by folding the hem flaps toward the exterior of the sidewalls and attaching them to the sidewall exterior surface, or the hems may be formed as separate elements that are attached to the sidewalls.

Figure 2:
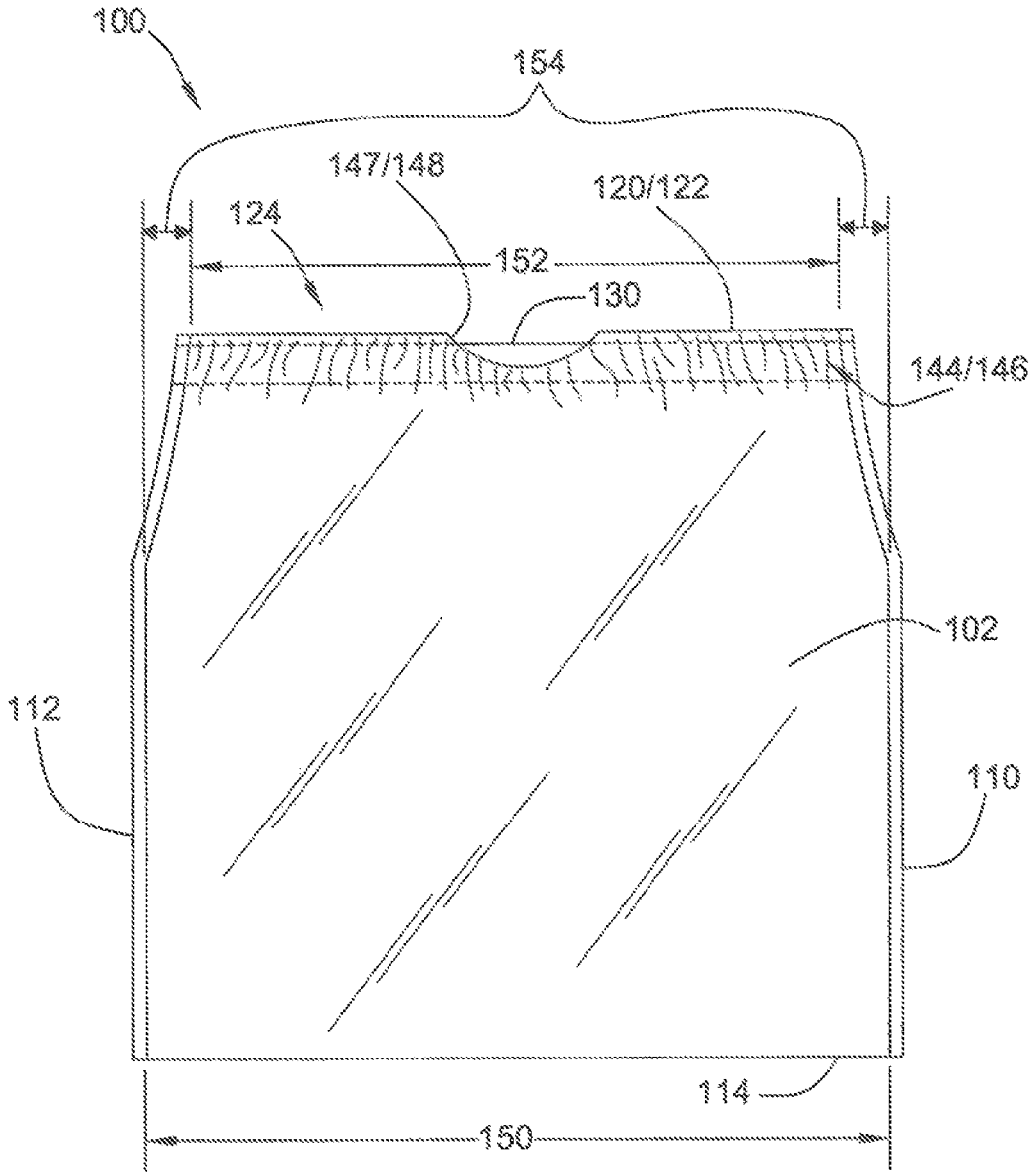
FIG. 2 is a front elevational view of the thermoplastic bag of FIG. 1.
Figure 3:
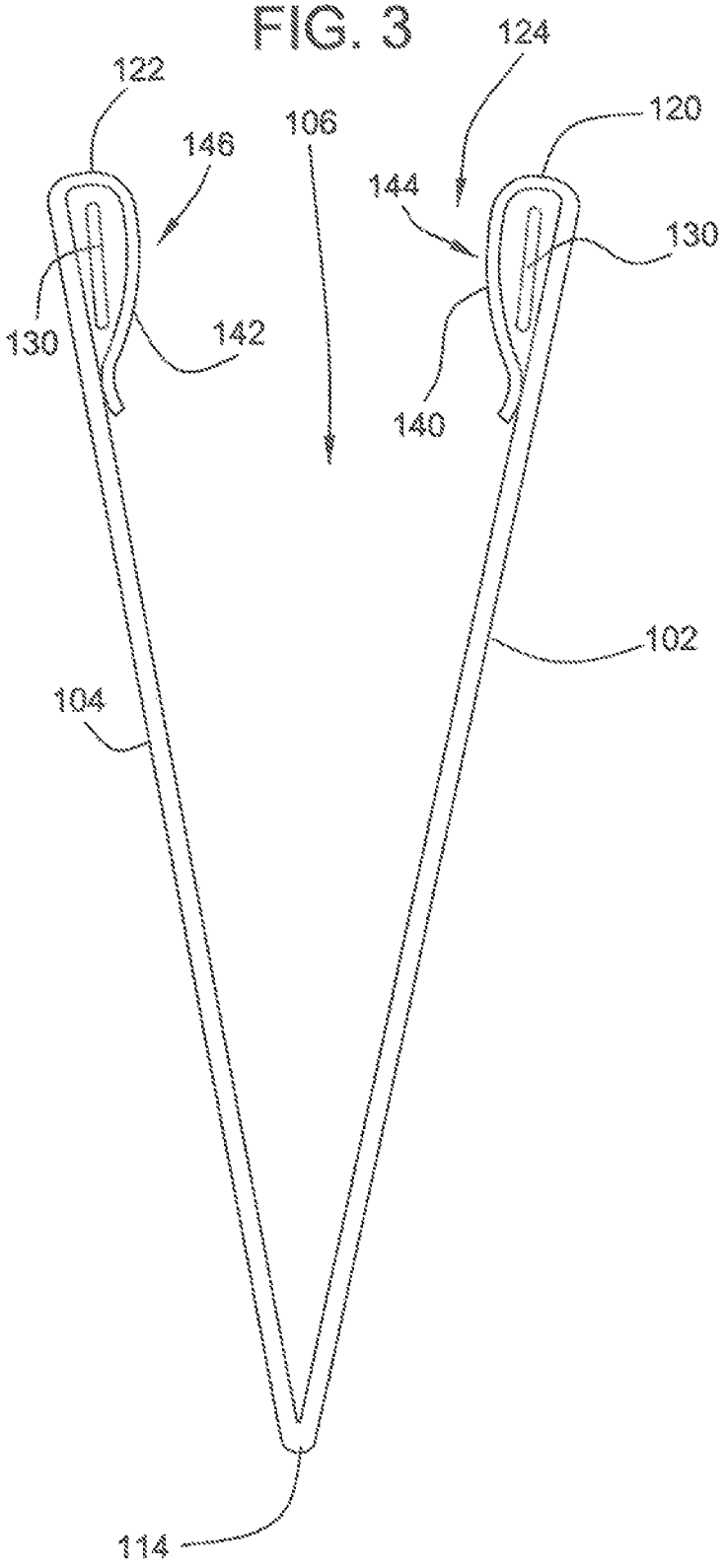
FIG. 3 is a cross-sectional view of the thermoplastic bag taken along line 3-3 of FIG. 1 and illustrating a draw tape accommodated in a hem.
Figure 4:
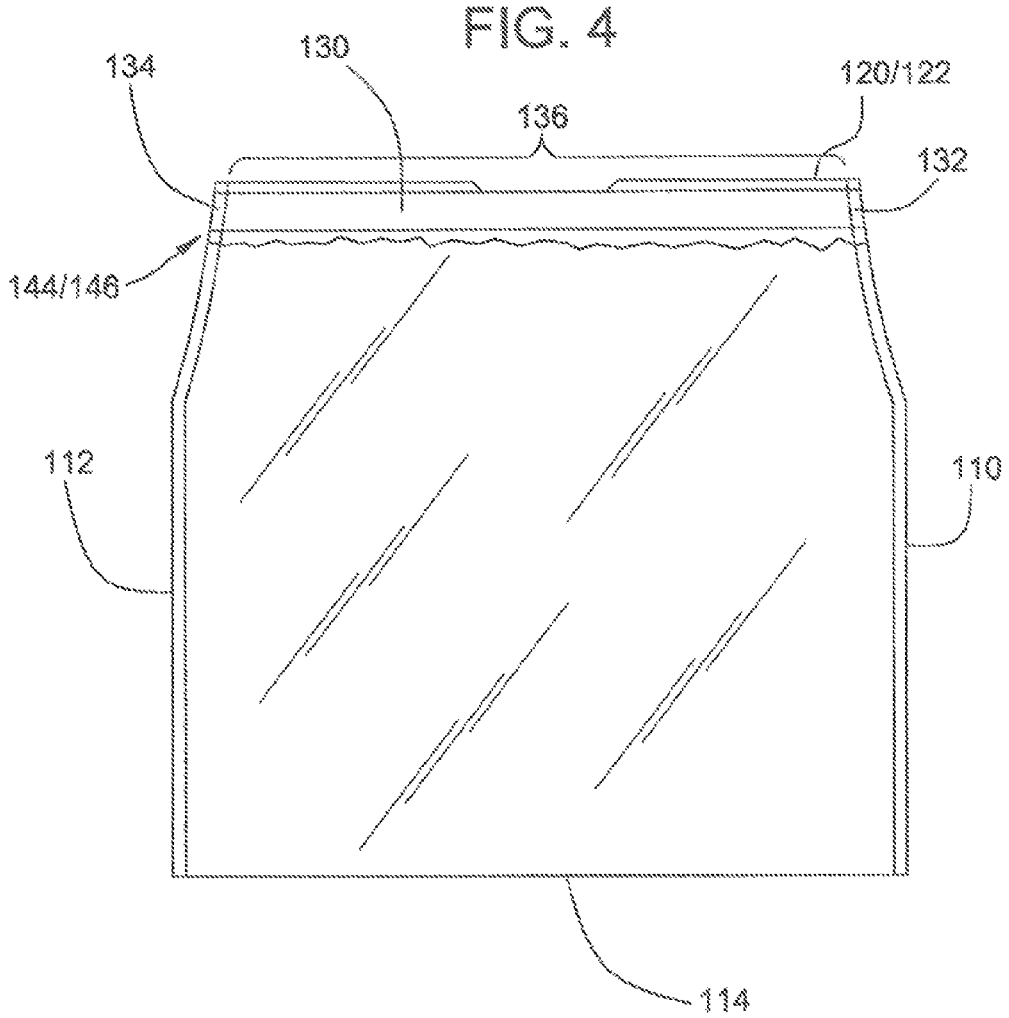
FIG. 4 is a partial cut away view of the thermoplastic bag showing the draw tape attached to the bag.

Referring to FIGS. 3 and 4, the draw tape 130 may be formed as an elongated strip of thermoplastic material. The elongated draw tape 130 has length between opposite first and second ends 132, 134 which are spaced apart by an intermediate section 136. When inserted into the hems 144, 146, the first and second ends 132, 134 may be attached to the first and second sidewalls 102, 104 at the respective first and second side edges 110, 112 while the intermediate section 136 may extend loosely through the first and second hems proximately along the first and second top edges 120, 122. In those embodiments in which the bag is heat sealed together, the first and second ends 132, 134 may be heat sealed to and in-between the first and second sidewalls 102, 104 at the respective first and second edges 110, 112. In another embodiment, only the draw tape ends may be attached together to form a closed loop that is freely accommodated in the hems, such as, the bag shown in FIG. 30. To access the draw tape 130, as illustrated in FIGS. 1 and 2, first and second notches 147, 148 may be disposed through the respective first and second top edges 120, 122. Pulling the draw tape 130 through the notches 147, 148 constricts the top edges 120, 122 thereby drawing closed the opening 124.

To assist in retaining the bag to a container, the draw tape 130 may have an elastic quality that allows it to expand and contract along its length. Further, as illustrated in FIGS. 1 and 2, the draw tape 130 may be sized so that, when in its contracted state, the draw tape partially constricts or pulls closed the opening 124 of the bag. Additionally, the elastically contracted state may be its natural or relaxed state. When the contracted draw tape 130 constricts the opening, the sidewall material at the top edges 120, 122 and/or the hems may gather or shirr together to provide a pleat-like appearance.

For example, referring to FIG. 2, when the bag 100 is laid flat it may have a first width 150 as measured along the bottom edge 114 from the first side edge 110 to the second side edge 112. Because the width 150 represents the front side of the bag, the perimeter at that location is twice the width 150 to account for the front side and the rear side of the bag. The width 150 may have a first range from about 8 inches (20.32 cm) to about 40 inches (101.6 cm), a second range from about 23 inches (58.42 cm) to about 31 inches (78.74 cm), and a third range from about 23 inches (58.42 cm) to about 25 inches (63.5 cm). In one embodiment, the width 150 may be about 24 inches (60.96 cm). When the draw tape 130 contracts, however, the bag may have a second width 152 as measured along the top edges 120, 122 delineating the opening 124. Because the width 152 represents the front side of the bag, the perimeter at that location is twice the width 152 to account for the front side and the rear side of the bag. The width 152 may have a first range from about 6.5 inches (16.51 cm) to about 38.5 inches (97.79 cm), a second range from about 20 inches (50.8 cm) to about 29 inches (73.66 cm), and a third range from about 20 inches (50.8 cm) to about 22 inches (55.88 cm). In one embodiment, the width 152 may be about 21.5 inches (54.61 cm). Thus, the second width is less than the first width and the bag is narrower at its top than its bottom. Because of the difference in the first and second widths, the side edges 110, 112 are each pulled towards each other along the top edges 120, 122 a distance 154. In those embodiments in which the draw tape 130 is attached to the bag at the first and second side edges 110, 112, the edges are physically pulled towards each other by contraction of the tape. The distance 154 is the difference between the first width 150 and the second width 152. Because the distance 154 represents the front side of the bag, the perimeter at that location is reduced by twice the distance 154 to account for the front side and the rear side of the bag. The distance 154 may have a first range from about 0.5 inch (1.27 cm) to about 8 inches (20.32 cm), a second range from about 1.5 inches (3.81 cm) to about 6 inches (15.24 cm), and a third range from about 1.5 inches (3.81 cm) to about 3.5 inches (8.89 cm). In one embodiment, the distance 154 may be about 2.50 inches (6.35 cm) and thus, the perimeter is reduced by 5 inches (12.7 cm).

Figure 5:
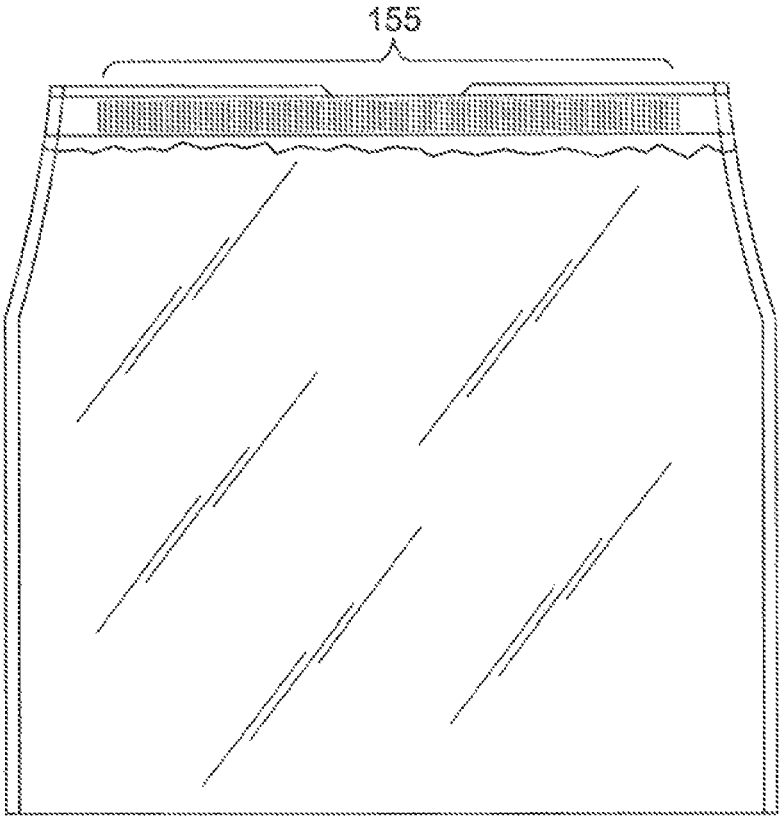
FIG. 5 is a partial cut away view of a thermoplastic bag showing another embodiment of a draw tape attached to the bag.

FIG. 5 illustrates another embodiment wherein the intermediate section 155 includes a pattern which will be further described herein. In one embodiment, the draw tape may be pre-stretched which will be further described herein. In another embodiment, the draw tape may not be pre-stretched.

Figure 6:
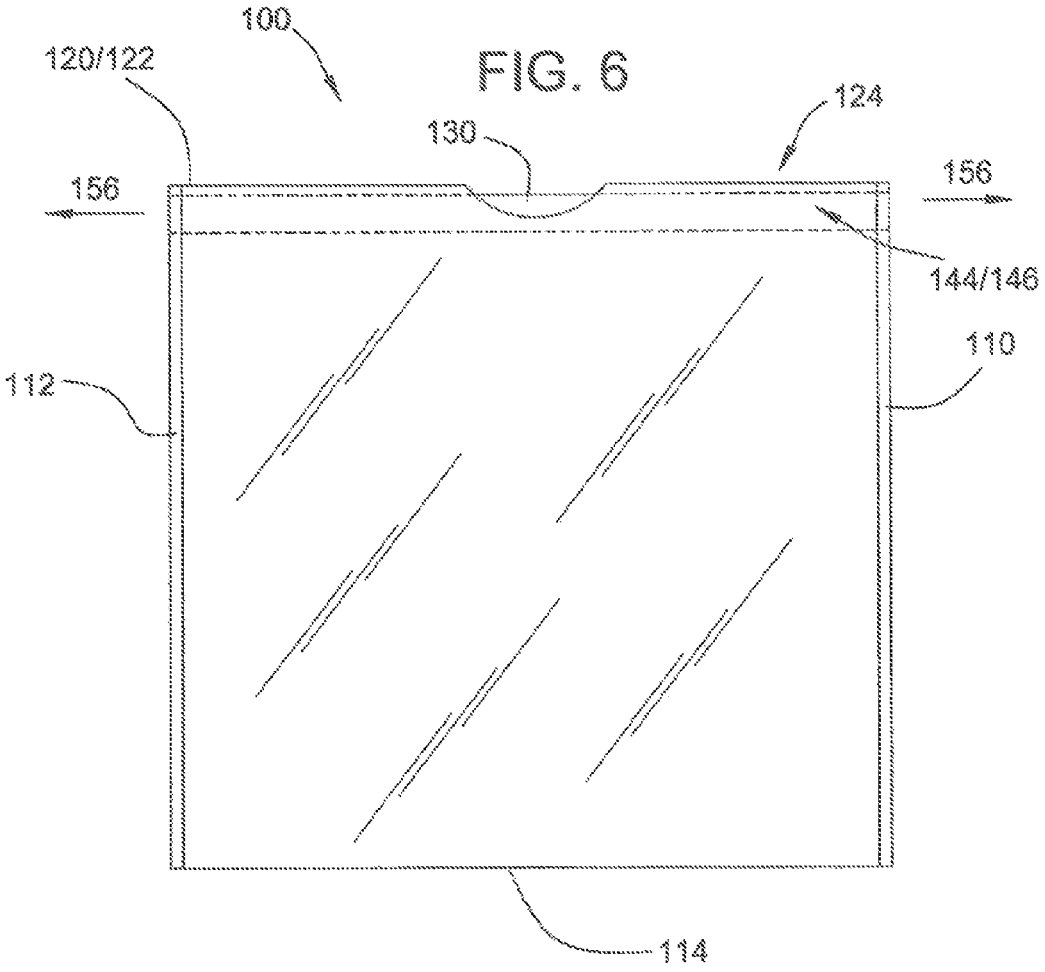
FIG. 6 is a front elevational view of the thermoplastic bag with a draw tape in an expanded or stretched state to un-constrict the bag opening.

Because of the elastic quality of the draw tape material, the draw tape 130 as illustrated in FIG. 6 may be stretched or expanded to more fully open the opening 124. For example, when a tensioning force 156 is applied so as to pull the first and second side edges 110, 112 away from each other, the opening 124 un-constricts so that the top edges 120, 122 have generally the same width as the bottom edge 114. Additionally, the side edges 110, 112 become generally straight and parallel with respect to each other and the bag 100 returns to a generally rectangular shape. Because the draw tape 130 is for the most part loosely accommodated in the hems, the draw tape 130 may expand or stretch freely in the hem. Additionally, the sidewall material along the top edges 120, 122 and hems 144, 146 flattens or smoothes out.

Figure 7:
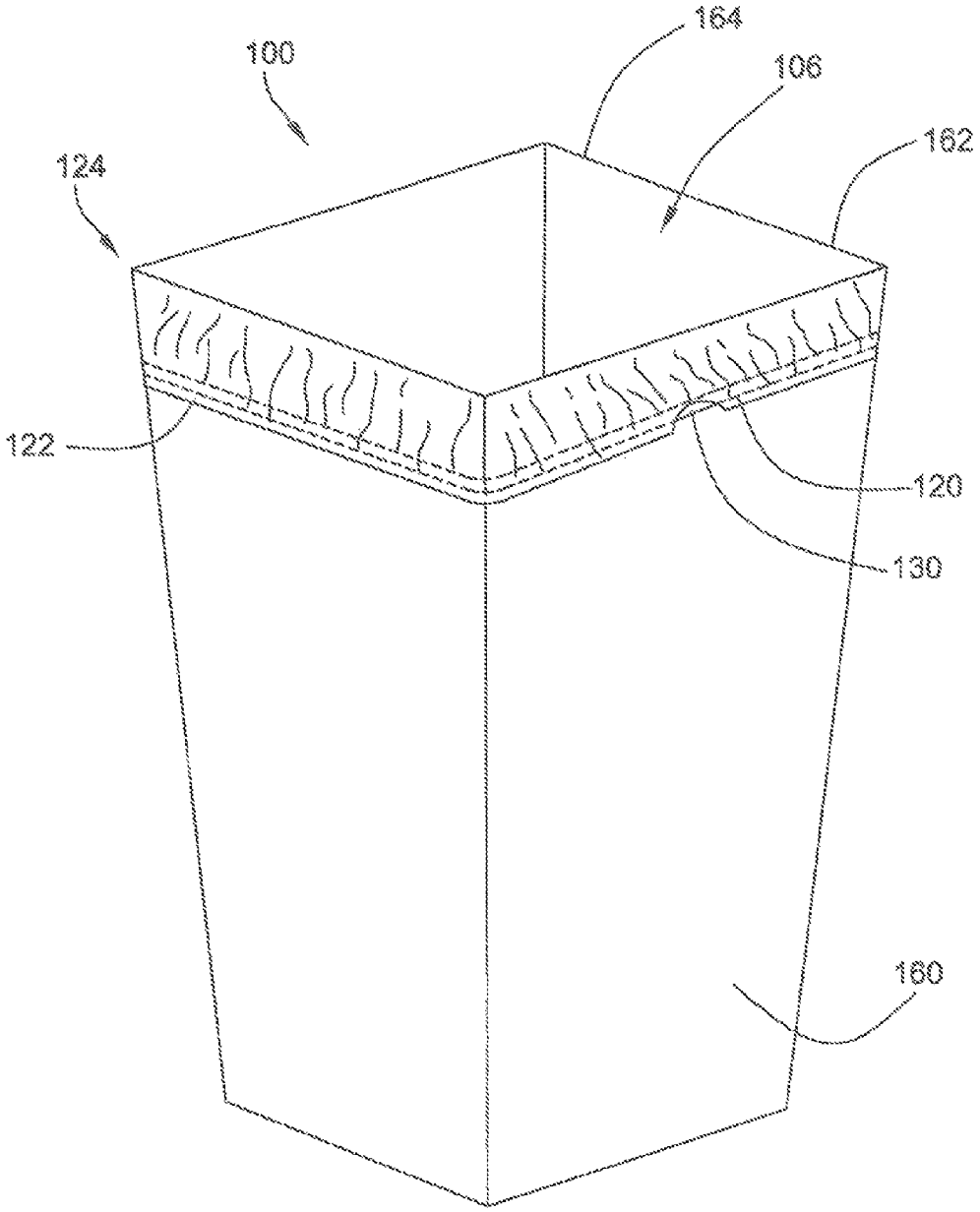
FIG. 7 is a top perspective view of the thermoplastic bag inserted in and retained to a refuse canister.

Thus, when inserting the bag 100 into a canister 160, as illustrated in FIG. 7, the draw tape 130 may be stretched as described herein and the top edges 120, 122 including the draw tape folded over the upper rim 162 of the canister. The bag 100 is thereby positioned vertically with the canister 160 and its interior volume 106 readily exposed to receive trash. Additionally, the length of the draw tape may be roughly equivalent to or slightly less than the perimeter 164 of the canister 160. By way of example, the canister 160 may have a perimeter 164 of 47 inches (119.38 cm), which may be over twice the width 152 of the bag 100 corresponding to the opening 124 as described herein. When the draw tape 130 is released and returns or recovers to its contracted condition, the draw tape cinches around and grips to the outer periphery of the canister 160. This helps prevent the bag from falling into the canister, especially as trash and other refuse items are put into and collect within the lined canister. In the illustrated embodiment, the canister 160 is formed as an upright rectangular structure with a square cross section, but the bag is intended for use as a liner with trash canisters of any shape.

In one embodiment, the draw tape 130 may be made from an elastic material. For example, the elastic material may be low density polyethylene, very low density polyethylene, ultra low density polyethylene, or ethylene vinyl acetate, and may be formed in combinations and in single or multiple layers. The draw tape may have elastic characteristics which allow the draw tape to stretch or extend when under tension and which allow the draw tape to relax or retract when not under tension. Referring the FIG. 6, the draw tape 130 may be attached at the first and second edges 110, 112 with the side seals when the draw tape 130 is in an extended state under tension. For example, the draw tape may be stretched or extended from about 10% to about 50% from its relaxed state. After the side seals are completed, the draw tape 130 will relax or retract and the draw tape contracts and narrows the mouth of the bag as shown in FIG. 4. By narrowing the bag mouth, the draw tape 130 will need to be stretched for the bag mouth to fit over a different sized canister. The draw tape also holds the bag in place as trash or other contents are added. Since the relaxed draw tape is shorter than the hem, the hem will gather and the gathered hem will make the "stretch to grip" feature of the draw tape apparent to the consumer. The shorter than normal draw tape also provides a potential reduction in the cost of material.

Figure 8:
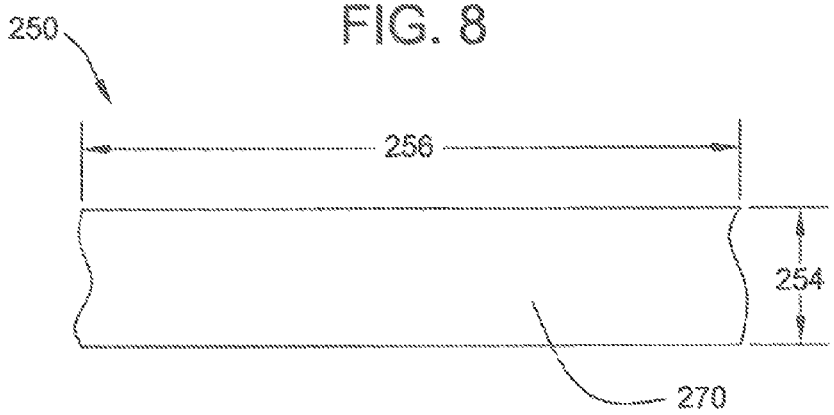
FIG. 8 is a front elevational view of another embodiment of a strip of draw tape material pre-stretched to provide an elastic characteristic for use in the thermoplastic bag, the material illustrated in a partially recovered or contracted condition or state.

Referring to FIG. 8, the draw tape 250 may be formed from an elongated strip 270 of thermoplastic material. Suitable materials may include polymers, for example, polyethylenes (such as, high density polyethylene, low density polyethylene, linear low density polyethylene, very low density polyethylene), polypropylene, ethylene vinyl acetate, nylon, polyester, ethylene vinyl alcohol, ethylene-methyl acrylate, or polystyrene, and may be formed in combinations and in single or multiple layers. The strip may have a thickness in a first range from about 0.0005 inches (0.0013 cm) to about 0.010 inches (0.0254 cm), a second range from about 0.001 inches (0.0025 cm) to about 0.003 inches (0.0076 cm), and a third range from about 0.0016 inches (0.0041 cm) to about 0.002 inches (0.0051 cm). In one embodiment, the thickness may be about 0.0018 inches (0.0046 cm).

Figure 9:
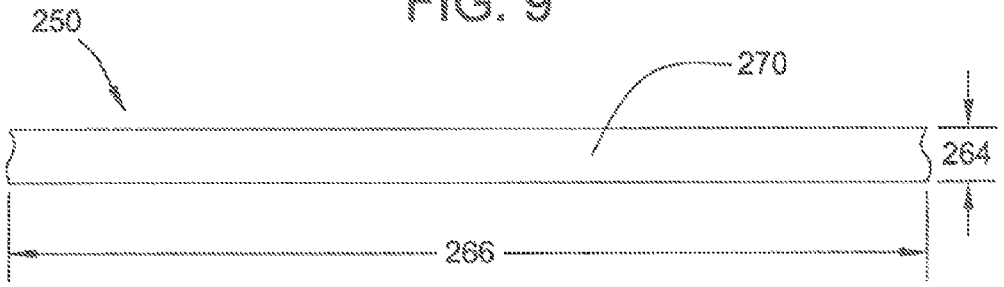
FIG. 9 is a front elevational view of the strip of draw tape material of FIG. 8 illustrating the material in a stretched condition or state.

Referring to FIGS. 8 and 9, there is illustrated an embodiment of a strip of material 250 that may be used for the draw tape and that has an elastic characteristic for use in a thermoplastic bag. To provide the elastic characteristic, the draw tape 250 may be stretched prior to insertion in the hem. Pre-stretching may modify the elastic quality of the draw tape allowing expansion and contraction and may facilitate stretching of the strip by a consumer during insertion of the bag into a receptacle. Pre-stretching may be accomplished by placing the strip in tension such as by pulling the ends of the strip to stretch it along its length. After insertion into the hem and attachment to the bag, the stretched strip may then be allowed to recover, at least in part, towards its original length. Recovery of the stretched tape may partially constrict the opening in a similar fashion to the above described embodiments of the bag.

By way of example, a pre-stretched strip 250 in its contracted state illustrated in FIG. 8 may have a width 254 and a length 256. The width 254 may have a range from about 0.50 inches (1.27 cm) to about 2 inches (5.08 cm). When stretched or tensioned, as illustrated in FIG. 9, the pre-stretched strip may have a reduced width 264 in comparison to width 254 in a first range from about 5% to about 50%, a second range from about 10% to about 30%, and a third range from about 12% to about 20%, and an increased length 266 in comparison to length to length 256 in a first range from about 10% to about 67%, a second range from about 15% to about 30%, and a third range from about 18% to about 25%. The tensioned strip may also have a reduced thickness. In one embodiment, the width 254 may be about 1.125 inches (2.86 cm) and the width 264 may be about 1.05 inches (2.67 cm) for a reduction of 6.7%, and the length 256 may be about 21 inches (53.34 cm) and the length 266 may be about 24 inches (61 cm) for an increase of 12.5%. By way of example only, the load to elongate a 20 inch length of pre-stretched strip by 4 inches may be reduced approximately 33% when compared with the same strip that is not pre-stretched. Thus, the pre-stretched tape is easier to stretch and expand when attaching to a container. Another possible advantage of pre-stretching the strip is that the pre-stretched strip retains its tensile strength per unit thickness in the direction of stretch. This enables a greater quantity of draw tapes to be made from a single roll of strip material resulting in cost savings of material. In other embodiments, the pre-stretched strip may also be imparted with a pattern to modify the elastic characteristics.

Figure 10:
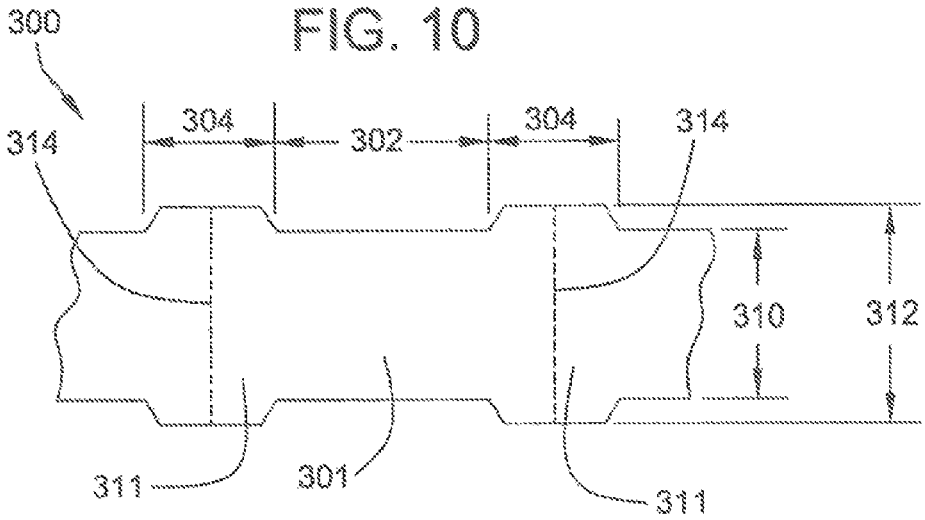
FIG. 10 is a front elevational view of another embodiment of the strip of draw tape material pre-stretched and having a first width and a second width, the first width less than the second width, the material illustrated in a partially recovered or contracted condition or state.
Figure 11:
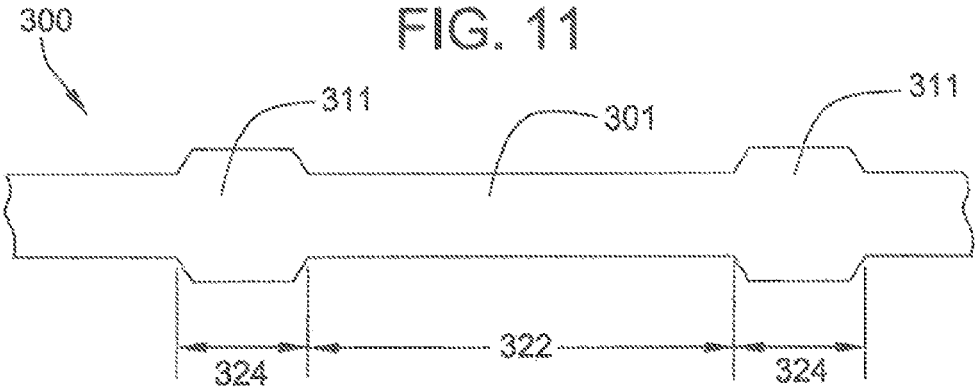
FIG. 11 is a front elevational view of the pre-stretched strip of draw tape material of FIG. 10 illustrating the material in a stretched condition or state.

Referring to FIGS. 10 and 11, there is illustrated another embodiment of a pre-stretched strip of thermoplastic material tape 300 for use as a draw tape that may have varying widths along its length. As illustrated in FIG. 10, when in its contracted state, the strip may have a region 301 with a length 302 and a width 310 and may have a region 311 with a length 304 and a width 312. By way of one example, the length 302 may have a range from about 12 inches (30.48 cm) to about 22 inches (55.88 cm). In one embodiment, the length 302 may be about 18.5 inches (46.99 cm). As one example, the width 310 may have a range from about 0.25 inches (0.64 cm) to about 1.9 inches (4.83 cm). In one embodiment, the width 310 may be about 1.05 inches (2.667 cm). As one example, the second length 304 may have a range from about 0.5 inches (1.27 cm) to about 6 inches (15.24 cm). In one embodiment, the length 304 may be about 3 inches (7.62 cm). As one example, the width 312 may have a range from about 0.5 inches (1.27 cm) to about 2 inches (5.08 cm). In one embodiment, the width 312 may be about 1.125 inches (2.858 cm). Thus, the width 310 is narrower than the width 312. When the strip is cut along the dotted lines 314 to make finished draw tapes, the region 301 may correspond to the intermediate sections and the regions 311 may correspond to the draw tape ends that attach to the side walls. As described herein, because the ends of the draw tape are wider, there is more surface area and material to form an attachment with the side edges.

The strip 300 may be intermittently pre-stretched to produce the different widths. For example, the regions 301 of the strip may be placed under tension to pre-stretch them, while the regions 311 remain un-stretched. Intermittent pre-stretching may cause the regions 301 to neck down compared to the regions 311 thereby producing the different widths. Referring to FIG. 10, another possible result of pre-stretching only the region 301 of the strip that corresponds to the intermediate portion of the finished draw tape is that only the region 301 may demonstrate modified elasticity. The un-stretched regions 311 that correspond to the end portions may relatively resist stretching. Thus, only the stretchable regions 301 may undergo an increase in length 322 while the regions 311 generally maintain their width 302. In the stretched condition, the length 322 may increase beyond the length 302 in a first range from about 5% to about 50%, a second range from about 10% to about 25%, and a third range from about 10% to about 15%. In one embodiment, the length 322 may increase beyond the length 302 by about 12.5%. The length 324 may have a range from about 0.5 inches (1.27 cm) to about 6 inches (15.24 cm). In one embodiment, the length 324 may be about 3 inches (7.62 cm). This stretching may be beneficial in the embodiments where the intermediate portion expands and contracts freely in the hem. By not pre-stretching regions 311, the lengthwise direction orientation stays the same, avoiding related negative orientation effects with respect to attaching and/or heat sealing of side edges. Furthermore, the presently described embodiment of the strip may be imparted with a pattern to modify the elasticity.

Figure 12:
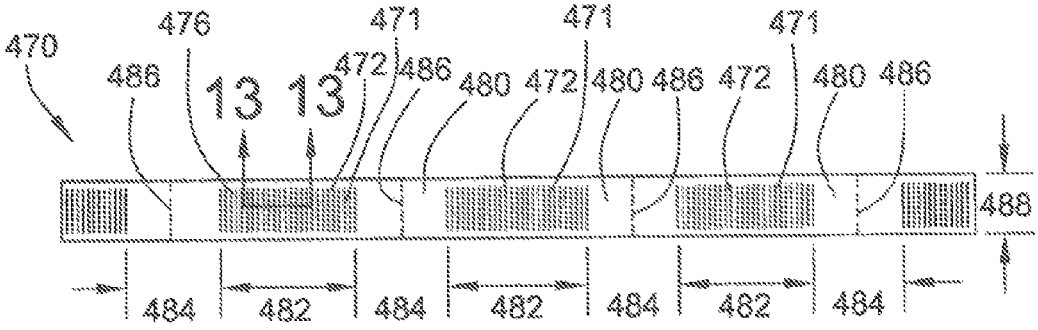
FIG. 12 is a front elevational view of a strip of draw tape material having a pattern providing an elastic characteristic intermittently formed into it for use in the thermoplastic bag.
Figure 13:
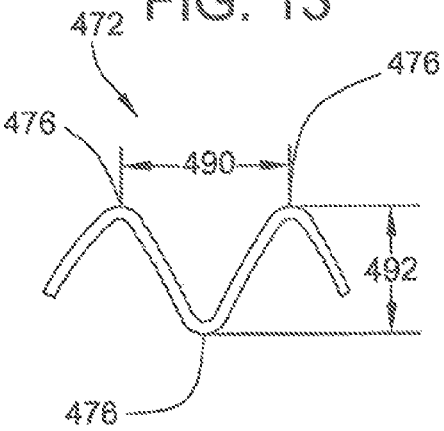
FIG. 13 is a cross-sectional view taken along lines 13-13 of FIG. 12 showing the strip with a pattern in a contracted state or condition.
Figure 14:
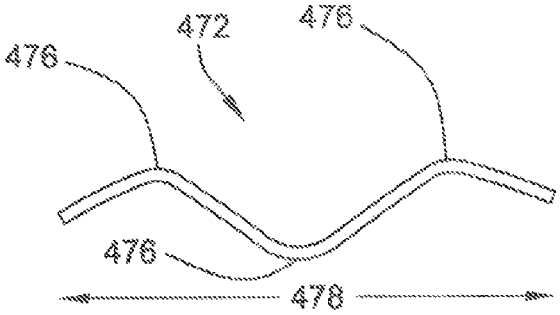
FIG. 14 is a cross-sectional view similar to that of FIG. 13 showing the strip with the pattern in a stretched or expanded condition or state.

Referring to FIG. 12, the draw tape may be formed with a pattern. Formed intermittently along the length of the strip 470 may be multiple regions 471 of patterns 472. The patterns 472 may take the form of linearly arranged ribs 476 that may extend across the width of the strip 470. Referring to FIGS. 12 and 13, the ribs 476 may be parallel and adjacent to one another and perpendicular to the length of the strip 470 such that the thermoplastic material has a generally corrugated or wavy shape with the ribs bunched closely together. However, when a tensioning force is applied to the pattern 472 by, for example, pulling the strip in the direction 478 as shown in FIG. 14, the ribs 476 may unfold thereby flattening the thermoplastic material out in a manner that causes the strip to expand in length. Additionally, the thermoplastic material of the strip may demonstrate shape memory or resiliency by which, when the tensioning force is released, the ribs 476 reform or refold thereby causing the strip 470 to contract. The pattern thereafter may regain its corrugated or wavy shape as illustrated in FIG. 13. Thus, as may be appreciated, the pattern 472 may provide the draw tape with an elastic quality. The pattern 472 may operate in the same manner as the pattern 750 in FIGS. 19-20.

In the embodiment illustrated in FIG. 12, the regions 471 of patterns 472 may be separated by regions 480 in which the strip 470 is not patterned. The region of patterning may have a length 482. The length 482 may have a first range from about 3 inches (7.62 cm) to about 39.5 inches (118.5 cm), a second range from about 12 inches (30.5 cm) to about 29.5 inches (74.9 cm), and a third range from about 12 inches (30.5 cm) to about 23.5 inches (59.7 cm). In one embodiment, the length 482 may be about 18.5 inches (47 cm). The region 480 may have a length 484. The length 484 may have a range from about 0.5 inches (1.27 cm) to about 6 inches (15.24 cm). The strip may have a width 488. The width 488 may have a range from about 0.5 inches (1.27 cm) to about 2 inches (5.08 cm). When the strip 470 is cut along dotted lines 486 to form the individual draw tapes, the region 471 may correspond to the intermediate section of the draw tape that is loosely accommodated in the hem and the regions 480 may correspond to the ends of the draw tape that are attached to the bag at the side edges. Because the regions 480 lack patterning in the illustrated embodiment, they may be more readily attached to the sidewalls, especially during heat sealing operations. In another embodiment, the strip may be pre-stretched and then the pattern imparted to the pre-stretched strip.

Referring to FIG. 13, the ribs 476 may have a distance 490 from peak to peak. The distance 490 may have a range from about 0.01 inches (0.025 cm) to about 0.12 inches (0.3 cm). In one embodiment, the distance 490 may be about 0.06 inches (0.15 cm). The ribs may have a height 492 from peak to valley. The height 492 may have a range from about 0.005 inches (0.013 cm) to about 0.24 inches (0.61 cm). In one embodiment, the height 492 may be about 0.05 inches (0.127 cm).

In other embodiments, the pattern may be in other locations and/or the pattern may have a different size. In another embodiment, the strip 470 may not include the regions 480 and may include a pattern along the entire length of the strip. In other embodiments, the ribs may be arranged in a different manner. For example, the ribs may be at an angle with respect to the length of the draw tape in a range from about 1 degree to about 90 degrees, such as, 30 degrees, 45 degrees, or 60 degrees. In another embodiment, the ribs may have different shapes, such as, arcs, chevrons, or waves.

Figure 15:
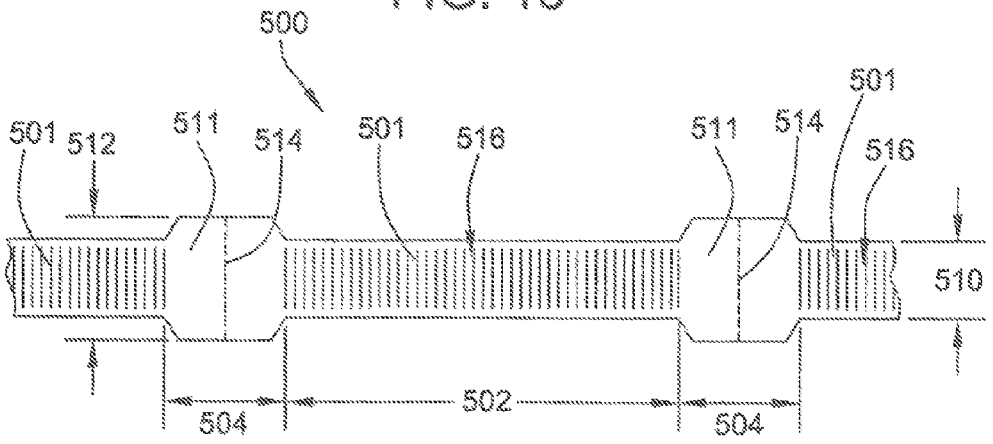
FIG. 15 is a front elevational view of another embodiment of a strip of draw tape material with a pattern and having a first width and a second width, the first width less than the second width.

Referring to FIG. 15, there is illustrated another embodiment of a draw tape 500 having an elastic characteristic for use in the thermoplastic bag. The draw tape 500 may include first regions 501 having a length 502 and a width 510 and second region 511 having a length 504 and a width 512. The width 510 may be in a range from about 0.25 inches (0.64 cm) to about 1.9 inches (4.83 cm). The width 512 may be in a range from about 0.5 inches (1.27 cm) to about 2 inches (5.08 cm). The dimensions of the length 502 may be similar to the dimensions for length 482 in FIG. 12 and the dimensions of the length 504 may be similar to the dimensions for length 484 in FIG. 12. When the strip 500 is cut along dotted lines 514 into individual draw tapes, the first region 501 may correspond to the intermediate portion of the draw tape that is loosely accommodated in the hems and the second region 511 may correspond to the opposing ends attached to the sidewalls.

Additionally, in the illustrated embodiment of the variable width strip 500, the patterning 516 may be applied to those regions 501 corresponding to the first, narrower width 510 while the regions 511 may remain smooth and/or un-patterned. The pattern 516 may provide the elastic characteristic that allows the region 501 to stretch and contract in the hems. The regions 511 may correspond to those end portions that attach at the side edges. By making the regions 511 wider, there is more material and surface area to attach and/or heat seal to the side edges. In one embodiment, the regions 501 may correspond to the pre-stretched region and regions 511 may correspond to the region which is not pre-stretched. By not pre-stretching regions 511, the lengthwise direction orientation stays the same, avoiding related negative orientation effects with respect to attaching and/or heat sealing of side edges. Another possible advantage of the regions 511 is that the pattern may not interfere with forming the side seals.

Figure 16:
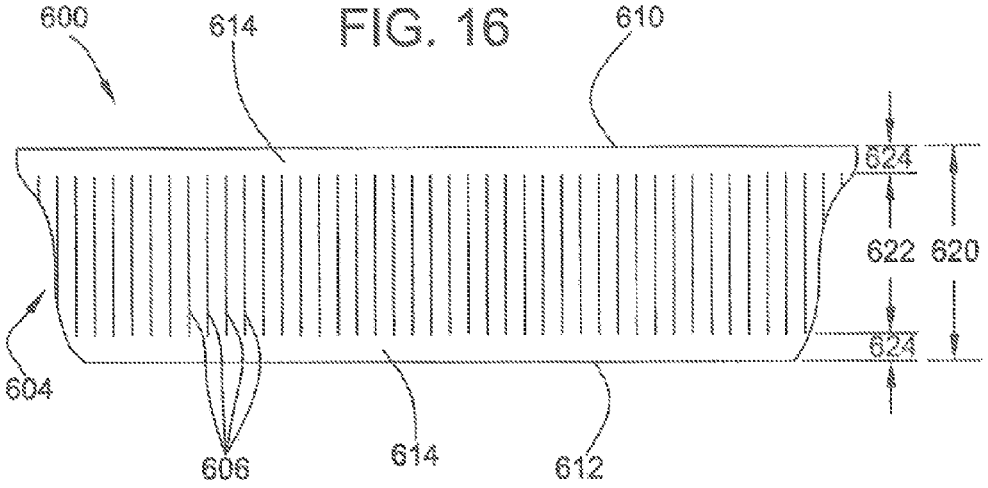
FIG. 16 is a front elevational view of a strip of draw tape material with a pattern.

Referring to FIG. 16, there is illustrated another embodiment of a strip 600 of thermoplastic material that may be used for the draw tapes. The strip 600 has imparted onto it a pattern 604 including a plurality of linear ribs 606. The ribs may be arranged in parallel with one another and may be perpendicular to the length of the strip. In the illustrated embodiment, the ribs 606 can be offset from the upper longitudinal edge 610 and lower longitudinal edge 612 of the strip. Thus, the pattern 604 substantially occupies an intermediate portion of the strip while the other portions 614 of the strip proximate the upper and lower longitudinal edges 610, 612 may remain relatively smooth and flat.

For example, the strip may have an overall width 620 of about 1.1 inches (2.794 cm). The pattern 604 may extend a distance 622 across the intermediate portion of the strip. The distance 622 may have a first range from about 0.2 inches (0.508 cm) to about 1.1 inches (2.794 cm), a second range from about 0.800 inches (2.032 cm) to about 0.99 inches (2.585 cm), or a third range from about 0.85 inches (2.154 cm) to about 0.925 inches (2.35 cm). In one embodiment, the distance 622 may be about 0.89 inches (2.261 cm). The other portions 614 of the strip corresponding to the upper and lower longitudinal edges 610, 612 may have a distance 624. The distance 624 may have a first range from about 0 inches (0 cm) to about 0.45 inches (1.145 cm), a second range from about 0.055 inches (0.14 cm) to about 0.15 inches (0.381 cm), or a third range from about 0.088 inches (0.222 cm) to about 0.125 inches (0.3175 cm). In one embodiment, the distance 624 may be about 0.105 inches (0.267 cm). In another embodiment, the portions 614 either above or below the pattern 604 may not be equal to each other. In another embodiment, one of the portions 614 may be eliminated with the ribs 606 intersecting either the upper or lower longitudinal edge 610, 612. In another embodiment, the spacing of the ribs may not be continuous to create a discontinuous pattern, such as, two ribs and then two spaces. In further embodiments, the locations of the pattern 604 and the other portions 614 illustrated in FIG. 16 may be switched.

The pattern promotes lengthwise expansion and contraction of the strip. However, the portions 614 associated with the upper and lower longitudinal edges 610, 612 generally resist expansion and contraction of the strip. Adjusting the dimensional ranges of the pattern and the portions with respect to each other provides some control over the degree or distance the strip is cable of expanding and contracting, and the amount of force necessary for causing such expansion and contraction. The pattern 604 may operate in the same manner as the pattern 750 in FIGS. 19-20.

Figure 17:
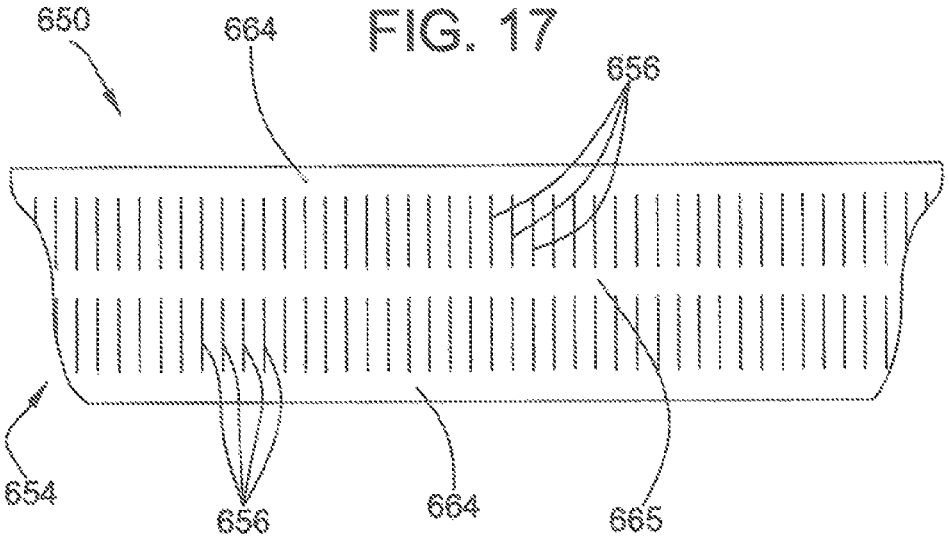
FIG. 17 is a front elevational view of a strip of draw tape material with a pattern.

Referring to FIG. 17, another embodiment of a draw tape is illustrated. The draw tape 650 may be similar to the draw tape 600 except that the draw tape 650 may include a portion 665 between the ribs 656. The portion 665 and the portions 664 may be similar to portions 614 in FIG. 16, such as, similar dimensions. The draw tape 650 may require additional force to stretch the draw tape 650 due to the portion 665, versus a similar draw tape without the portion 665. In other embodiments, the draw tape may include additional portions 665, such as, two, three, four or more portions. The pattern 654 may have different shapes, such as, polygons (such as, diamonds, trapezoids, rectangles, hexagons, octagons or other polygons), circles, ovals, brick pattern and/or lattice pattern. The pattern 654 may be letters, numbers and/or images, such as, company logo, seasonal or holiday shapes (such as, tree, snowman, wreath, ornament, firework, pumpkin, flower, leaf, heart), sports shapes (such as, football, soccer, baseball, basketball, hockey), strength shapes (such as, links of chain, bar bell, twisted rope or cable), and/or may spell words or phrases, such as, "Glad".

The thermoplastic bags described herein may include additional features to facilitate their use as liners for trash containers. For example, referring to FIG. 18, the bag 700 may have a pattern 750 formed onto the thermoplastic first and/or second sidewalls 702, 704. As illustrated, the pattern 750 may extend between the first and second side edges 710, 712 and from the closed bottom edge 714 toward the un-joined top edges 720, 722 delineating the opening 724. However, in other embodiments, the pattern may be formed over only select portions of the sidewall and in various designs. The pattern 750 provides the bag with a stretchable or yieldable characteristic. Examples of such patterns and similar features are described in U.S. Pat. No. 6,139,185; U.S. Publication No. 2004/0134923; U.S. Pat. No. 6,394,651; U.S. Pat. No. 6,394,652; U.S. Pat. No. 6,150,647; U.S. Pat. No. 6,513,975; and U.S. Pat. No. 6,695,476, each of which is herein incorporated by reference in its entirety and is set forth in its entirety herein.

Figure 19:
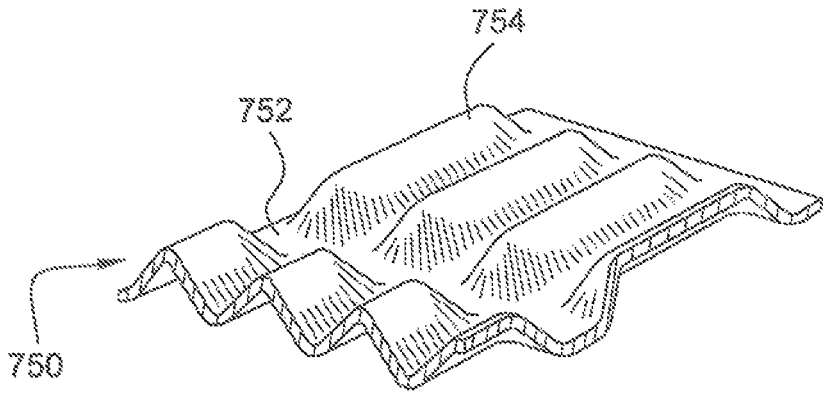
FIG. 19 is a detailed perspective view of the area indicated in FIG. 18 by circle 19-19 illustrating the thermoplastic material of the sidewall in an un-stretched condition.
Figure 20:
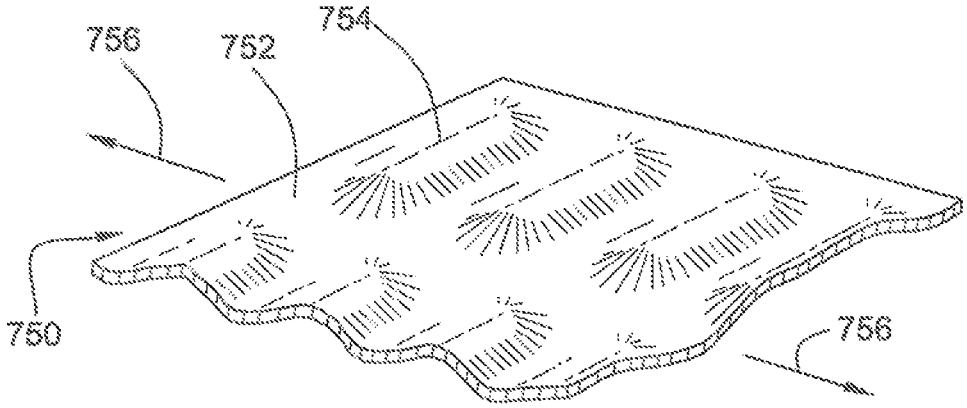
FIG. 20 is a detailed perspective view similar to that of FIG. 19 illustrating the thermoplastic material as stretched out.

Referring to FIGS. 19 and 20, the pattern 750 may be formed as a plurality of stretchable or strainable networks in which the normally planar, sheet-like thermoplastic material of the first and second sidewalls is bunched together in a series of short, parallel ribs. These include a plurality of first regions 752 that may correspond to the planar sheet of the sidewall and a plurality of second regions 754 formed as rib-like elements that protrude from the plane of the first regions and that appear bunched or concentrated together when in an un-tensioned state as illustrated in FIG. 19. When a pulling force 756 is applied, as shown in FIG. 20, the rib-like second regions 754 are able to unbend or geometrically deform so that the first and second regions 752, 754 become substantially co-planar with each other. As may be appreciated, this un-bunching action stretches or elongates the pattern thereby adding to the overall area of the sidewalls. Moreover, the thermoplastic sheet material into which the pattern 750 is formed may demonstrate shape memory causing the first and second regions to return to the geometry of the un-tensioned state illustrated in FIG. 19 when any applied forces are removed. Thus the bag 700 may demonstrate a degree of stretch or yield in the sidewalls that resists puncture or tear when bulky or odd shape objects are inserted. The pattern 750 may be used with any of the embodiments described herein, as appropriate.

Figure 21:
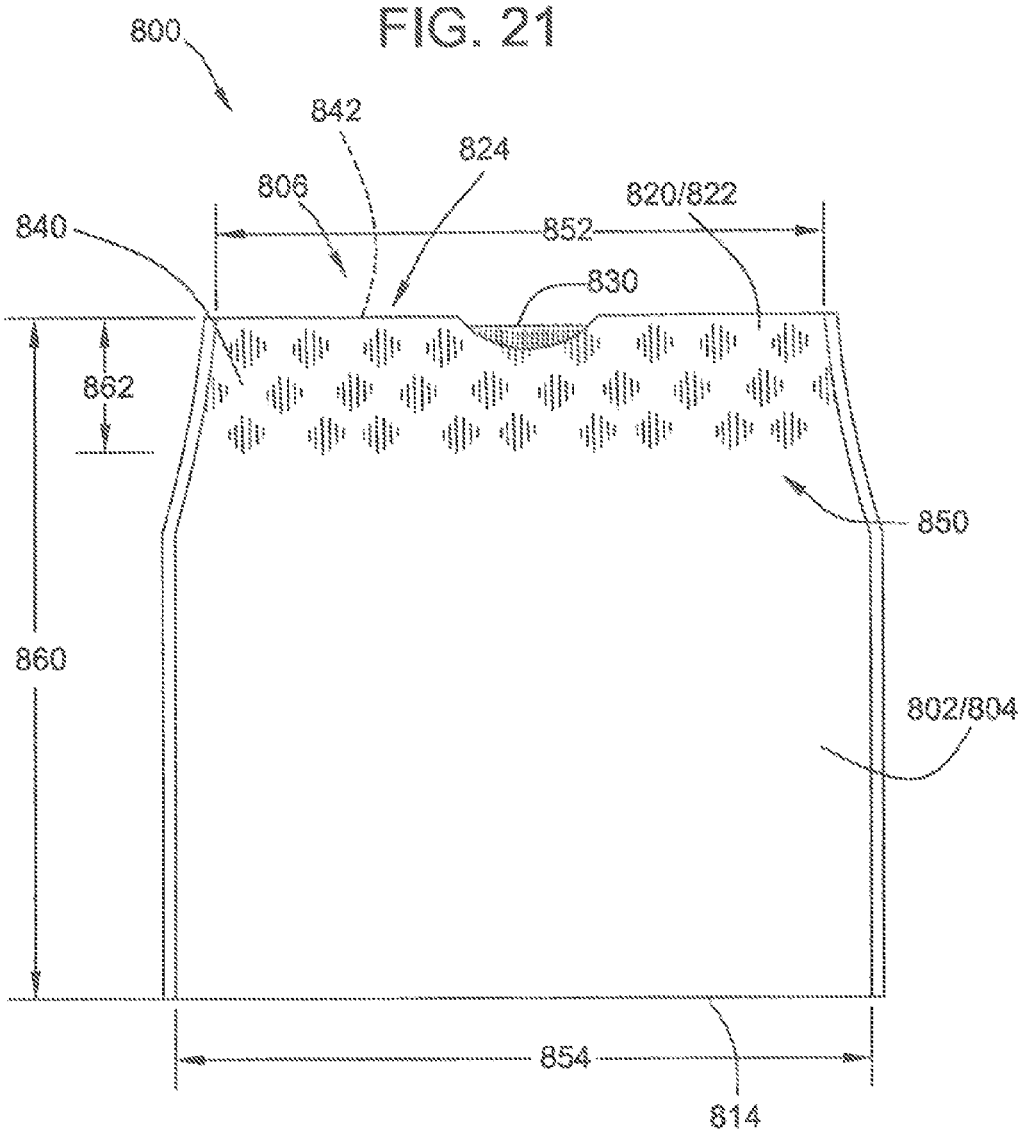
FIG. 21 is a perspective view of another embodiment of a thermoplastic bag having a draw tape and a pattern proximate the opening of the bag.

Referring to FIG. 21, there is illustrated another embodiment of a thermoplastic bag 800 that may be used as a liner for a trash receptacle. The illustrated bag 800 includes a first sidewall 802 and a second sidewall 804, both made of thermoplastic material, which are overlaid and joined to each other to define an interior volume 806. The interior volume 806 may be accessed via an opening 824 delineated by the un-joined first and second top edges 820, 822 of the respective first and second sidewalls 802, 804. To cinch closed the opening 824, the bag 800 may include a draw tape 830 that may be accommodated in hems 840, 842 formed proximate the opening. The draw tape 830 may include elastic characteristics as described herein, such as, the pre-stretched draw tape, the pre-stretched draw tape with a pattern, or the draw tape with a pattern and no pre-stretch.

At least one of the first and/or second sidewalls 802, 804 proximate the top edges 820, 822 including the hem 840, 842 may be formed with a pattern 850 as described with respect to FIGS. 19 and 20. By way of example, the bag 800 may have a height 860. The height 860 may have a first range from about 8 inches (20.3 cm) to about 46 inches (116.8 cm), a second range from about 20 inches (50.8 cm) to about 30 inches (76.2 cm), and a third range from about 23 inches (58.4 cm) to about 26 inches (66.04 cm). In one embodiment, the height 860 may be about 25.125 inches (63.82 cm). The pattern 850 can extend from the top edges 820, 822 toward the closed bottom edge 814 a distance 862. The distance 862 may have a first range from about 1 inch (2.54 cm) to about 10 inches (25.4 cm), a second range from about 2 inches (5.08 cm) to about 5 inches (12.7 cm), and a third range from about 3 inches (7.62 cm) to about 4 inches (10.16 cm). In one embodiment, the distance 862 may be about 3.6 inches (9.194 cm). The pattern 850 may include a plurality of bending and unbending rib-like elements that protrude from the plane of the sidewalls 802, 804. Because the pattern 850 provides a stretchable or yieldable characteristic, the pattern allows the opening 824 to be stretched or widened during, for instance, installation of the bag 800 onto a trash container. This feature not only enhances the ease of stretching the bag mouth to match the width of the bottom of the bag, but enables the bag mouth to stretch beyond the width of the bottom of the bag to accommodate larger trash cans.

Figure 22:
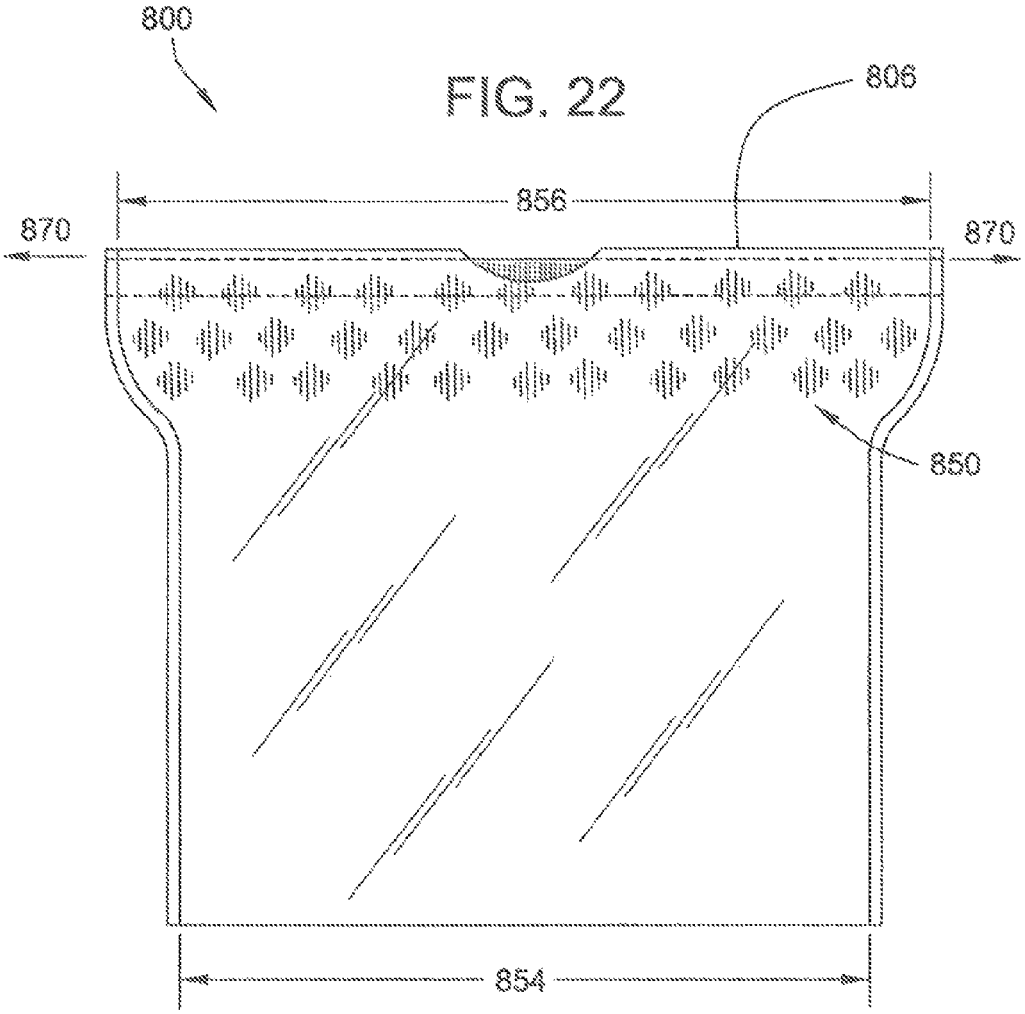
FIG. 22 is a front elevational view of the bag in a stretched condition.

Referring to FIG. 22, the opening 806 of the bag 800 has been stretched by applying force 870 to the bag. Referring to FIG. 21, the opening 806 may have a width 852. The width 852 may be the same dimensions as the width 152 in FIG. 2. The bag 800 may also have a width 854. The width 854 may be the same dimensions as the width 150 in FIG. 2. Referring to FIG. 22, the opening 806 may have a width 856 when a force is applied to the bag. The width 856 may increase in size over width 854 in a first range from about 0% to about 25%, a second range from about 2% to about 17%, and a third range from about 4% to about 13%. In one embodiment, the width 856 may increase in size over width 854 by about 10%. In one embodiment, the width 856 may increase in size over width 854 by using a force in a first range from about 1 lbf (4.48 N) to about 15 lbf (66.72 N), in a second range from about 2 lbf (8.9 N) to about 7 lbf (31.14 N), and in a third range from about 3 lbf (13.34 N) to about 5 lbf (22.24 N). These increases in width beyond the bag body width may apply to bags of all widths described herein, as appropriate.

In one example, the width 854 may be about 24 inches (60.96 cm) and the width 856 may have a first range from about 24 inches (60.96 cm) to about 30 inches (76.2 cm), a second range from about 24.5 inches (62.23 cm) to about 28 inches (71.12 cm), and a third range from about 25 inches (63.5 cm) to about 27 inches (68.58 cm). In one embodiment, the width 856 may be about 26.5 inches (67.31 cm). Thus, in one embodiment, the width 852 of 21.5 inches (54.61 cm) increased to the width 856 of 26.5 inches (67.31 cm).

The width 856 may have a first range from about 6.6 inches (16.76 cm) to about 64.3 inches (163.32 cm), a second range from about 20 inches (50.8 cm) to about 46 inches (116.84 cm), and a third range from about 24 inches (60.96 cm) to about 40 inches (101.6 cm). In one embodiment, the width 856 may be about 30 inches (76.2 cm).

In one example, the width 856 may increase in size over width 852 in a first range from about 1% to about 40%, a second range from about 5% to about 30%, and a third range from about 10% to about 25%. In one embodiment, the width 856 may increase in size over width 852 by 23%. For example, the width 852 may be about 21.5 inches (54.61 cm) and the width 856 may have a first range from about 21.7 inches (55.12 cm) to about 30 inches (76.2 cm), a second range from about 24.5 inches (62.23 cm) to about 28 inches (71.12 cm), and a third range from about 25 inches (63.5 cm) to about 27 inches (68.58 cm). In one embodiment, the width 856 may be about 26.5 inches (67.31 cm). Thus, in one embodiment, the width 852 of 21.5 inches (54.61 cm) increased to the width 856 of 26.5 inches (67.31 cm).

In another example, the width 856 may increase in size over width 852 in a first range from about 1% to about 67%, a second range from about 7% to about 52%, and a third range from about 14% to about 48%. In one embodiment, the width 856 may increase in size over width 852 by about 30%. For example, the width 852 may be about 18 inches (45.72 cm) and the width 856 may have a first range from about 24 inches (60.96 cm) to about 30 inches (76.2 cm), a second range from about 24.5 inches (62.23 cm) to about 28 inches (71.12 cm), and a third range from about 25 inches (63.5 cm) to about 27 inches (68.58 cm). In one embodiment, the width 856 may be about 26.5 inches (67.31 cm). Thus, in one embodiment, the width 852 of 18 inches (45.72 cm) increased to the width 856 of 26.5 inches (67.31 cm).

In another example, a bag may achieve greater stretch by using one or more of the elastic materials described herein. For example, the width 856 may increase in size over width 852 in a first range from about 1% to about 150%, a second range from about 10% to about 133%, and a third range from about 25% to about 125%. In one embodiment, the width 856 may increase in size over width 852 by about 121%. For example, the width 852 may be about 12 inches (30.48 cm) and width 856 may have a first range from about 13 inches (33.02 cm) to about 30 inches (76.2 cm), a second range from about 18 inches (45.72 cm) to about 28 inches (71.12 cm), and a third range from about 24 inches (60.96 cm) to about 27 inches (68.58 cm) In one embodiment, the width 856 may be about 26.5 inches (67.31 cm).

These increases in size of width 856 over width 852 may use the same force ranges as the forces noted herein for the increase is size of width 856 over width 854.

In another embodiment, the pattern may be any of the patterns described herein, as appropriate.

Figure 23:
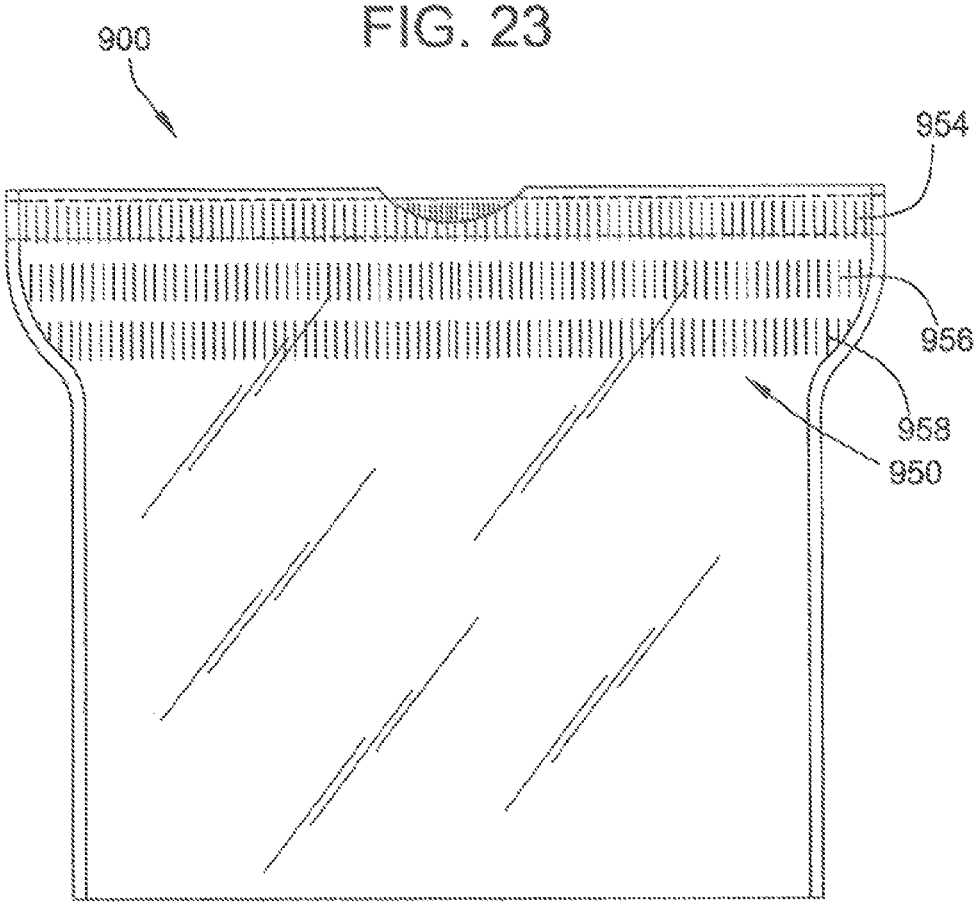
FIG. 23 is a front elevational view of another embodiment in a stretched condition.

Referring to FIG. 23, another embodiment of a bag is shown. The bag 900 may be similar to bag 800 except for the pattern 950. The pattern 950 may include ribs. The pattern 950 may be similar to the pattern 472 in FIG. 12. The pattern 950 allows the opening of the bag to stretch. In this embodiment, the bag 900 may include three rows 954, 956, 958 of the ribs. In other embodiments, the bag may include one, two, four, five, six or more rows. The pattern 950 may be used with any of the embodiments described herein, as appropriate. In another embodiment, the pattern may be any of the patterns described herein, as appropriate.

Figure 24:
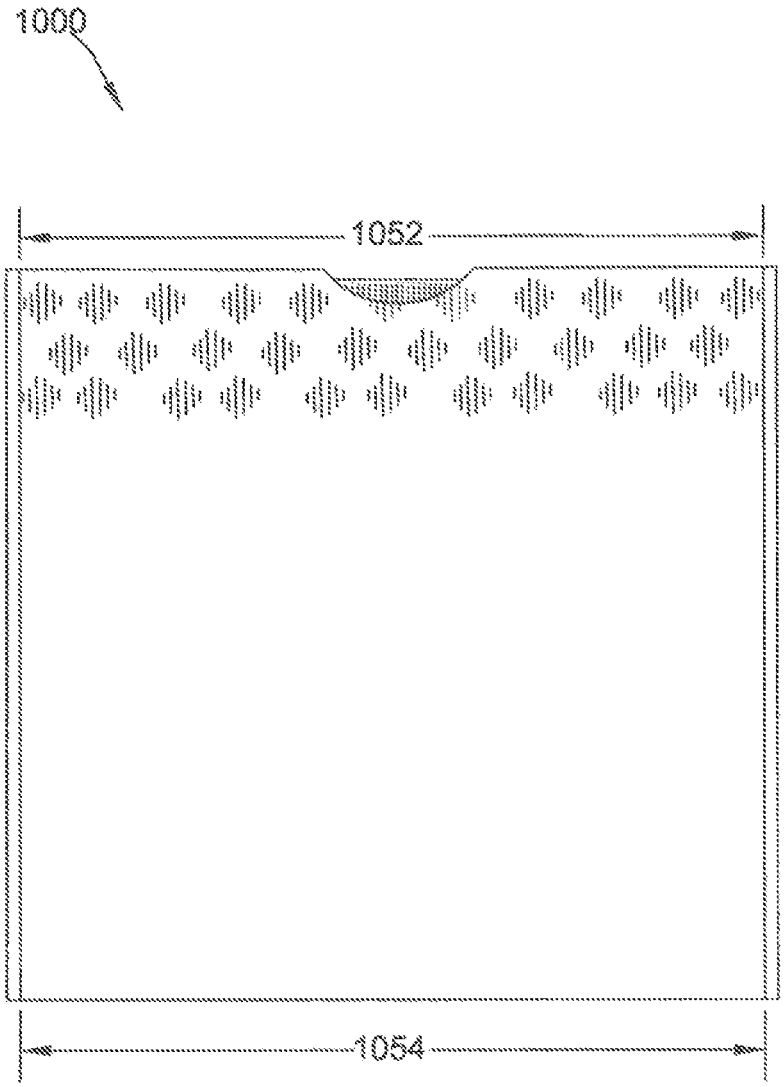
FIG. 24 is a front elevational view of another embodiment.

Referring to FIG. 24, another embodiment of a bag is shown. The bag 1000 may be similar to bag 800 except that the top of the bag 1000 is not constricted in the relaxed state. In one embodiment, the top of the bag 1000 may have an interior width 1052 which may be the same as the interior width 1054 of the bottom of the bag. The widths 1052, 1054 may have the same dimensions as width 854 in FIG. 22. When a force is applied to the opening of the bag, the width 1052 may increase similar to the dimensions of the width 856 of the bag 800 in FIG. 22. In another embodiment, the bag 1000 may include the pattern 950 in one or more rows as in FIG. 23. In another embodiment, the pattern may be any of the patterns described herein, as appropriate.

Figure 25:
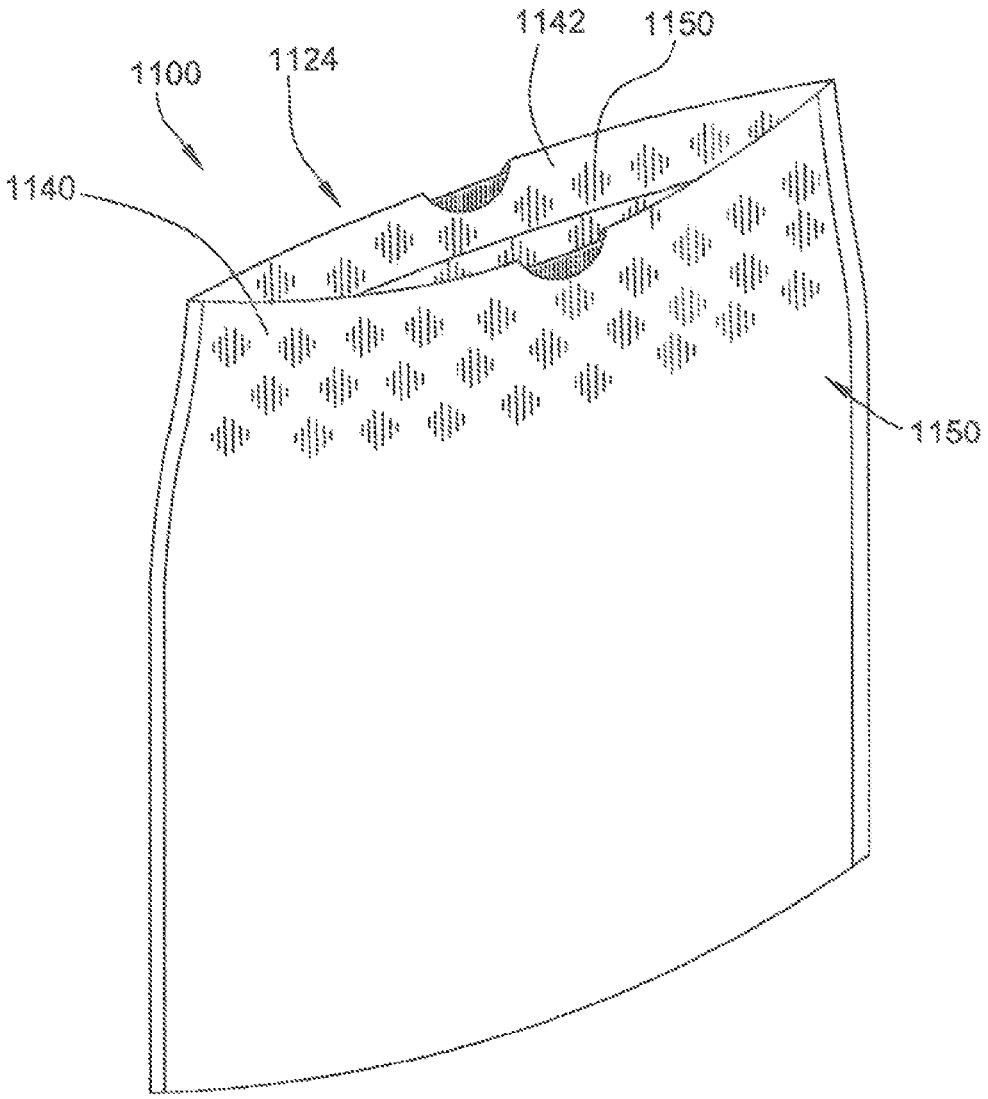
FIG. 25 is a perspective view of another embodiment.

Referring to FIG. 25, another embodiment of a bag is shown. The bag 1100 may be similar to the bag 800 except that the pattern 1150 may be also applied to the interior of the hems 1140,1142. The opening 1124 of the bag 1100 may stretch similar to the opening 824 of the bag 800 in FIG. 22. In another embodiment, the pattern may be applied to only the interior of one of the hems. In another embodiment, the pattern may be applied to the interior of one or both of the hems, but the pattern would not be applied to the exterior of the hem. The use of a pattern on the interior of a hem may be used with any of the embodiments described herein as appropriate. In another embodiment, the bag 1100 may include the pattern 950 in one or more rows as in FIG. 23.

In another embodiment, the pattern may be any of the patterns described herein, as appropriate.

Figure 26:
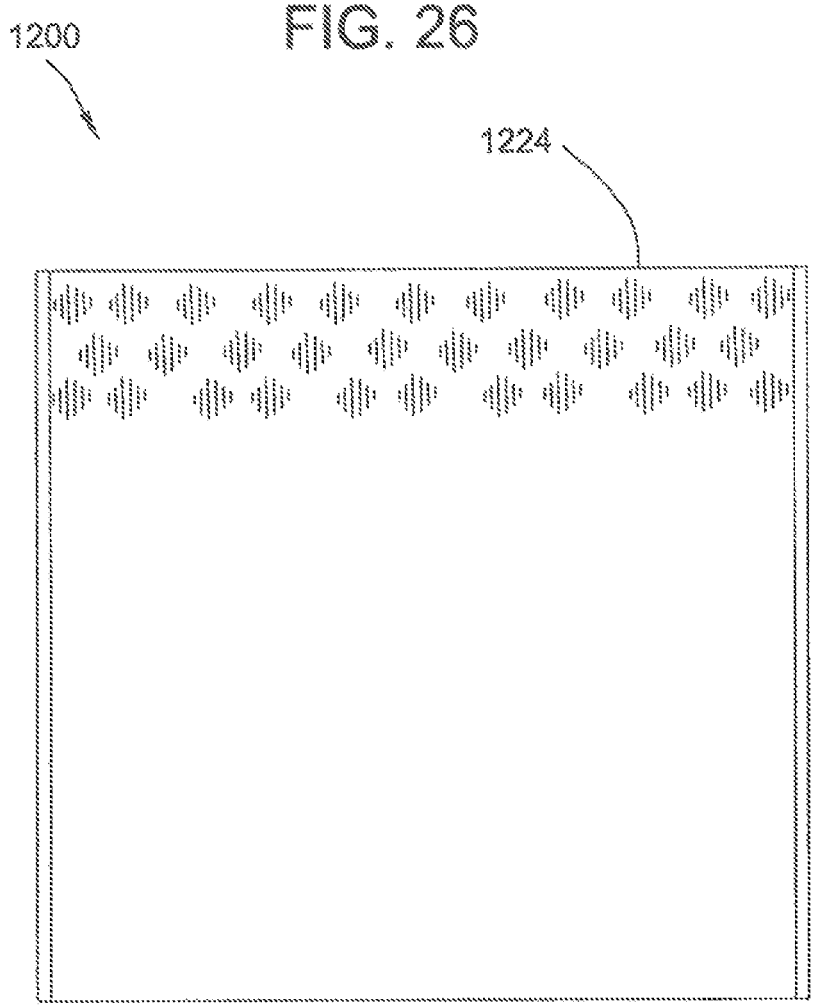
FIG. 26 is a front elevational view of another embodiment.

Referring to FIG. 26, another embodiment of a bag is shown. The bag 1200 may be similar to the bag 1000 in FIG. 24 except that the bag 1200 does not include a draw tape. The opening 1224 of the bag 1200 may stretch similar to the opening 824 of the bag 800 in FIG. 22. In other embodiments, the bag may be a flap tie bag or a handle tie bag. In another embodiment, the bag 1200 may include the pattern 950 in one or more rows as in FIG. 23. In another embodiment, the pattern may be any of the patterns described herein, as appropriate.

Figure 27:
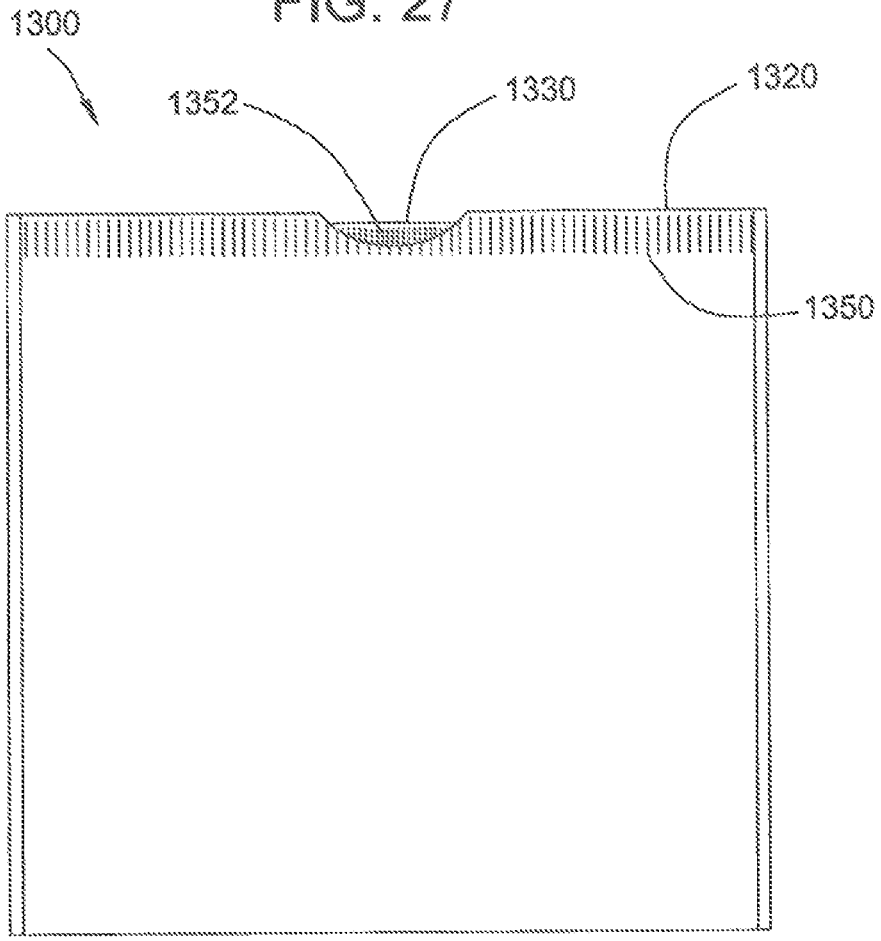
FIG. 27 is a front elevational view of another embodiment.

Referring to FIG. 27, another embodiment of a bag is shown. The bag 1300 may include a pattern 1350 near the top 1320 of the bag. In one embodiment, the pattern 1350 may be decorative and may not substantially facilitate the stretching of the bag mouth. The bag 1300 may include a draw tape 1330 and the draw tape 1330 may include a pattern 1352. In one embodiment, the pattern 1352 may be decorative and may not substantially facilitate the stretching of the bag mouth. In another embodiment, the pattern may be any of the patterns described herein, as appropriate. In one embodiment, the pattern may be printed onto the surface.

Figure 28:
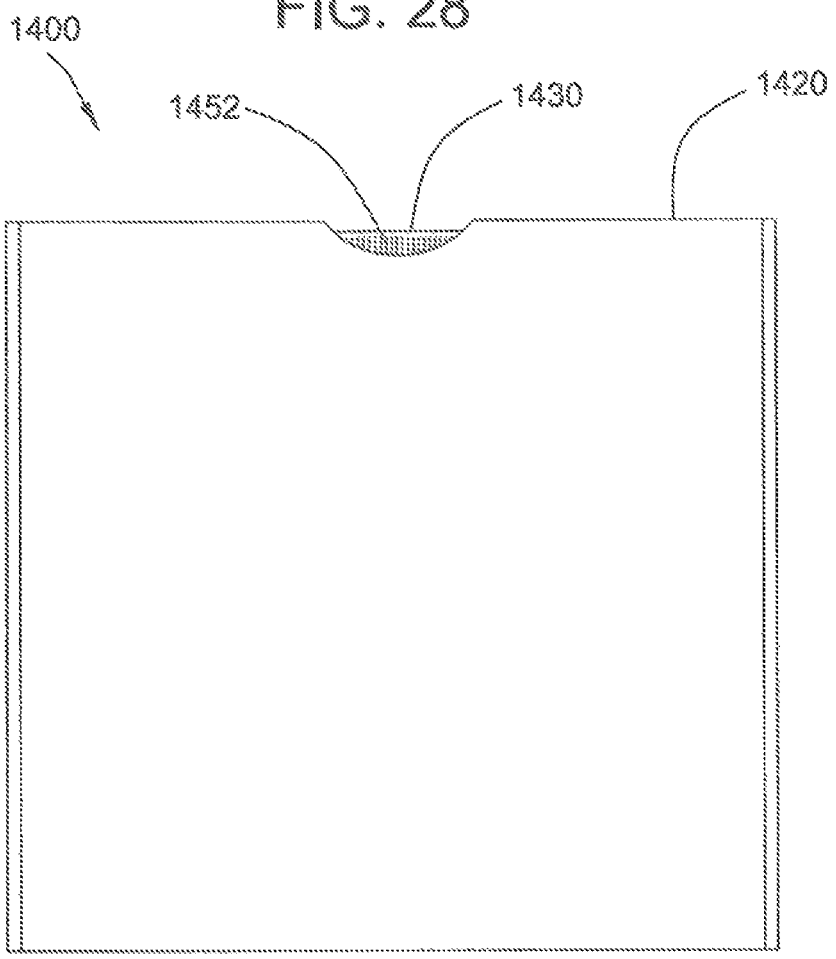
FIG. 28 is a front elevational view of another embodiment.

Referring to FIG. 28, another embodiment of a bag is shown. The bag 1400 may be similar to bag 1300 in FIG. 27 except that the top 1420 of the bag may not include a pattern. The bag 1400 may include a draw tape 1430 and the draw tape 1430 may include a pattern 1452. In one embodiment, the pattern 1452 may be decorative and may not substantially facilitate the stretching of the bag mouth. In another embodiment, the pattern may be any of the patterns described herein, as appropriate. In one embodiment, the pattern may be printed onto the surface.

Figure 29:
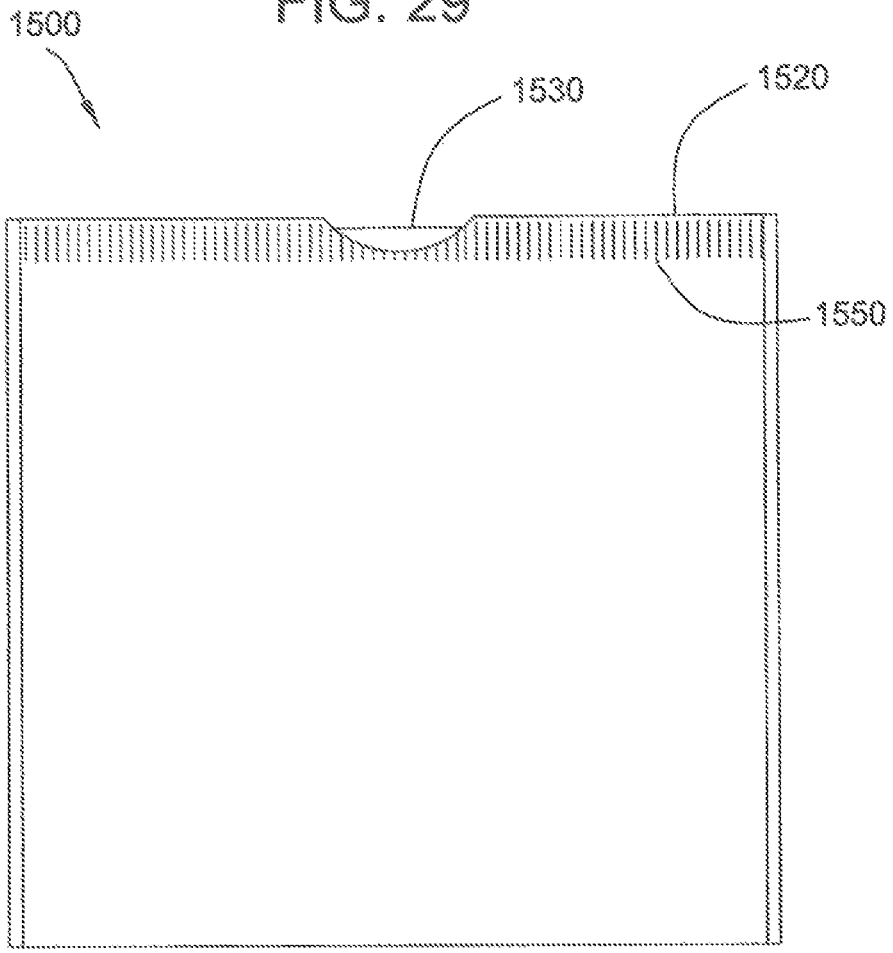
FIG. 29 is a front elevational view of another embodiment.

Referring to FIG. 29, another embodiment of a bag is shown. The bag 1500 may be similar to bag 1300 in FIG. 27 except that the draw tape 1530 may not include a pattern. The bag 1500 may include a pattern 1550 near the top 1520 of the bag. In one embodiment, the pattern 1550 may be decorative and may not substantially facilitate the stretching of the bag mouth. In another embodiment, the pattern may be any of the patterns described herein, as appropriate. In one embodiment, the pattern may be printed onto the surface.

Figure 30:
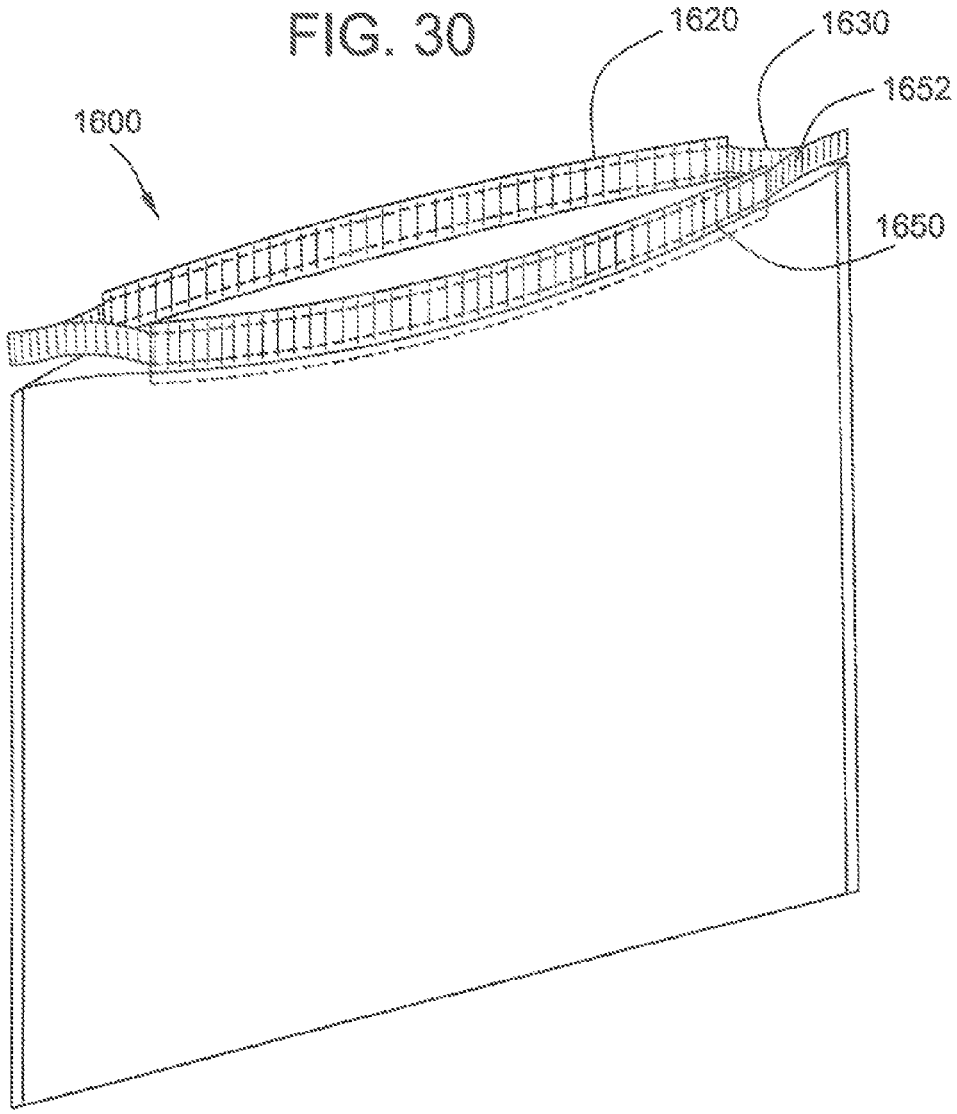
FIG. 30 is a perspective view of another embodiment.

Referring to FIG. 30, another embodiment of a bag is shown. The bag 1600 may be similar to bags described in U.S. Pat. No. 5,133,607, U.S. Pat. No. 6,059,458, and U.S. Pat. No. 6,402,377, each of which is herein incorporated by reference in its entirety and is set forth in its entirety herein. The bag 1600 may include a pattern 1650 near the top 1620 of the bag. In one embodiment, the pattern 1650 may facilitate the expansion of the bag mouth. The pattern may be any of the patterns described herein, as appropriate. In another embodiment, the pattern 1650 may be decorative and may not substantially facilitate the stretching of the bag mouth. The bag 1600 may include a draw tape 1630 and the draw tape 1630 may include a pattern 1652. In one embodiment, the pattern 1652 may facilitate the expansion of the bag mouth. The pattern may be any of the patterns described herein, as appropriate. In another embodiment, the pattern 1652 may be decorative and may not substantially facilitate the stretching of the bag mouth. In another embodiment, the bag may include a pattern near the top of the bag, and the draw tape may not have a pattern. In another embodiment, the draw tape may include a pattern, and the bag may not have a pattern near the top of the bag.

Figures 31, 32, 33:
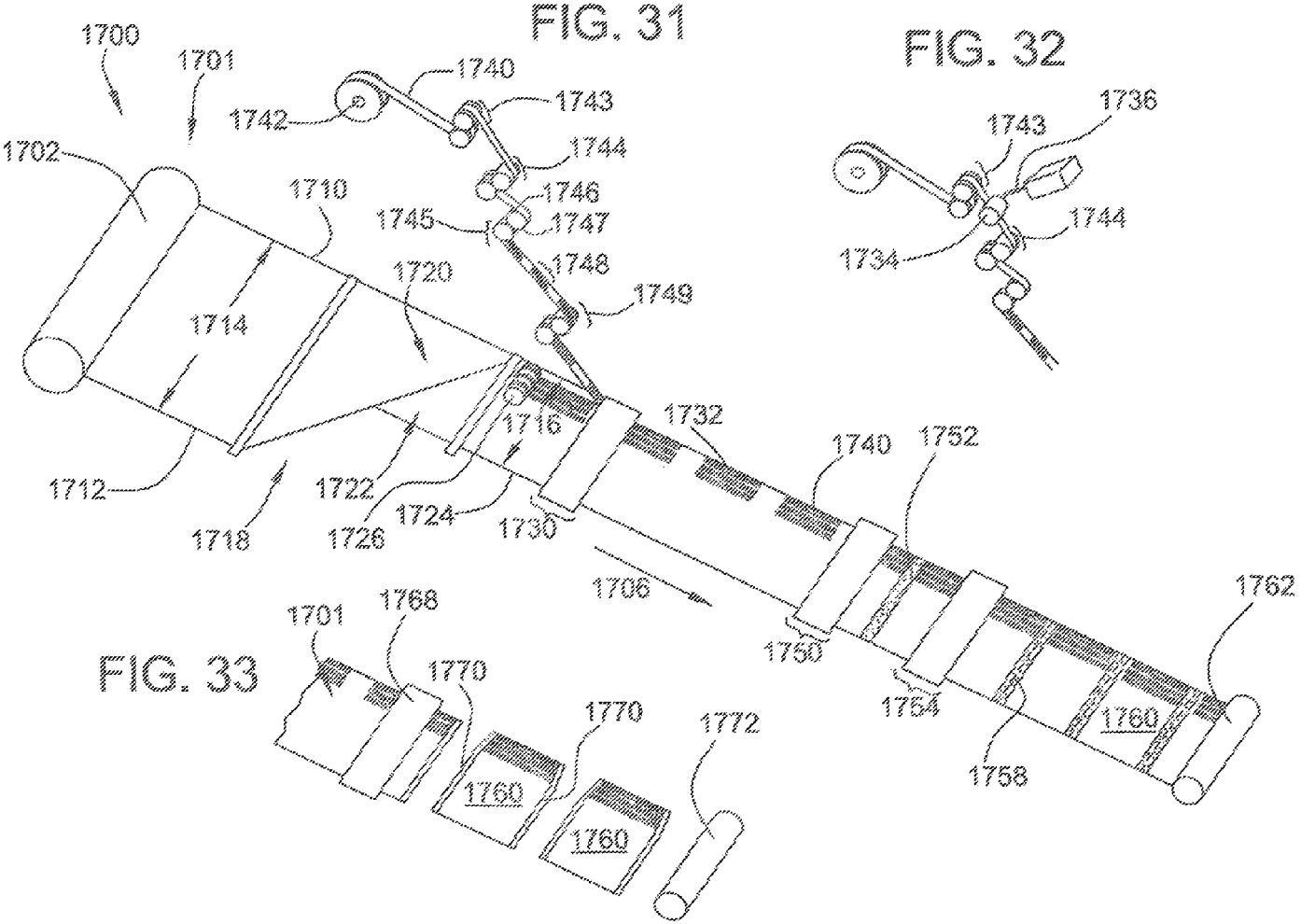
FIG. 31 is a schematic representation of a high speed manufacturing process for producing thermoplastic bags that may include draw tapes.
FIG. 32 is a schematic representation of some steps of another embodiment of the manufacturing process.
FIG. 33 is a schematic representation of some steps of another embodiment of the high speed manufacturing process in which thermoplastic bags are detached from the processed web.

Bags may be produced in a high speed, automated manufacturing process such as the one illustrated in FIG. 31. The illustrated manufacturing process 1700 includes automated equipment that may convert continuous sheet-like webs and thin film strips of planar thermoplastic material into the finished bags. For example, a web 1701 of thermoplastic material may initially be provided on a roll 1702 that may be unwound and movingly directed along a machine direction 1706 by the processing equipment. When unwound, the web 1701 may have a first side edge 1710 and a second side edge 1712 that define a width 1714 that is perpendicular to the machine direction 1706.

To provide the interior volume of the finished bag, the web 1701 may be folded in half orthogonally about the machine direction 1706 by a folding operation 1718 so that the web is arranged as first and second opposing, adjacent webs halves 1720, 1722 being advanced in parallel along the machine direction 1706. When folded in half, the first and second side edges 1710, 1712 are moved adjacent to each other. The width 1716 of the folded web 1701 may be half of the width 1714 of the unfolded web. Moreover, once folded, the center of the web 1701 provides a crease 1724 that may correspond to the bottom edge of the finished bag. In another embodiment, the roll 1702 may include a pre-folded web and the folding operation is not necessary. In another embodiment, a first web from a first roll and a second web from a second roll may be provided and advanced in parallel along the machine direction. The first and second webs may be joined along one edge to form the bottom portion of the bags.

In the embodiments, where a pattern may be imparted proximate to the top of the bag, the process may include one or more rollers 1726 to impart the pattern to the bag.

The hems may be formed along the adjacent edges 1710, 1712 by a hemming operation 1730 in which hem flaps may be tucked or folded into the web 1701. A hem may be formed for each of the adjacent edges 1710, 1712. The hemming operation may add notches 1732. The notches 1732 may be of any suitable shape or size and may be made through the advancing web 1701 intermittently along the adjacent edge 1710, 1712.

To provide the draw tape, a continuous strip 1740 of thermoplastic thin-film material may be unwound from a roll 1742 of such material. The strip 1740 is directed by various rollers and/or nips toward the advancing web where it may be inserted into the hems.

The manufacturing process 1700 may include equipment to pre-stretch the strip 1740 prior to installation in the bag. For example, the processing equipment may include a pair of opposing cylindrical rollers 1743 that are located before and spaced from a pair of rollers 1744. The strip material 1740 may be directed between the pair of rollers 1743 and then onto the pair of opposing cylindrical rollers 1744. If the pair of rollers 1744 are rotated at a faster relative speed than the pair of rollers 1743, the differential roller speeds will place the thermoplastic strip under tension and may thereby stretch or elongate it. This process of stretching may be referred to as pre-stretching. In a further embodiment, the relative speed of the pairs of rollers 1743, 1744 may be adjusted to vary the amount and location of the pre-stretching induced onto the strip 1740. For example, where the relative speed of the rollers is equal, the tape will undergo little or no stretching. If the differential speed is increased, the tape will be stretched and possibly neck down in width. Thus, varying the relative speed of the roller pairs with respect to each other may produce draw tapes with sections that may be pre-stretched and sections that may not be pre-stretched, the pre-stretched sections may be narrower than the sections that are not pre-stretched.

Referring to FIG. 32, another method of generating this intermittent pre-stretching is to have a constant speed differential between the roller pairs 1743, 1744 and forcing one or more rollers 1734 into and out of the draw tape path between the roller pairs 1743, 1744. The roller 1734 may be moved using an arm 1736, such as, a crank arm. In other embodiments, the roller 1734 may be moved by an air cylinder, hydraulic cylinder, eccentric connection, or other techniques. As the roller 1734 is moving into the draw tape path, pre-stretching may be increased. As the roller 1734 is moving out of the draw tape path, pre-stretching may be decreased or eliminated. The speed and travel of the roller 1734 may be controlled to achieve intermittent pre-stretching as well as to adjust the length and amount of pre-stretch.

Referring to FIG. 31, to impart the pattern into the strip, the processing equipment may include a pair of opposing rollers 1745 that may have intermeshing ridges 1746 and grooves 1747 formed on their surfaces. When the strip 1740 is directed between the rollers 1745 rotating in opposite directions, the ridges 1746 and grooves 1747 may impart the pattern 1748 onto the thermoplastic material. Moreover, the surfaces of the opposing rollers 1745 may be configured so that the pattern 1748 is only imparted onto intermittent lengths of the strip 1740.

To keep the strip 1740 including the pattern 1748 in a predetermined stretched or expanded condition, a second pair of opposing rollers 1749 may be provided downward from the patterning rollers 1745 and may be rotated at a speed necessary to maintain the predetermined stretched condition.

The stretched strip 1740 may then be directed toward the adjacent edges 1710, 1712 of the advancing web 1701 where the strip 1740 may be inserted in the hemming operation 1730. Once inserted, the strip 1740 is accessible through the notches 1732. A second roll of strip material may be similarly provided for insertion into the remaining hem of the two adjacent edges. It should be appreciated that in other embodiments of the manufacturing process, the order and/or presence of the hemming, notching and strip insertion operations may be altered or changed.

In another embodiment, the strip 1740 may not be stretched by rollers 1743, 1744, but may be processed by the rollers 1745 to receive the pattern. The strip 1740 may then be inserted under tension in the hem. The tension may or may not be sufficient to stretch or expand the pattern.

Figures 39, 40:
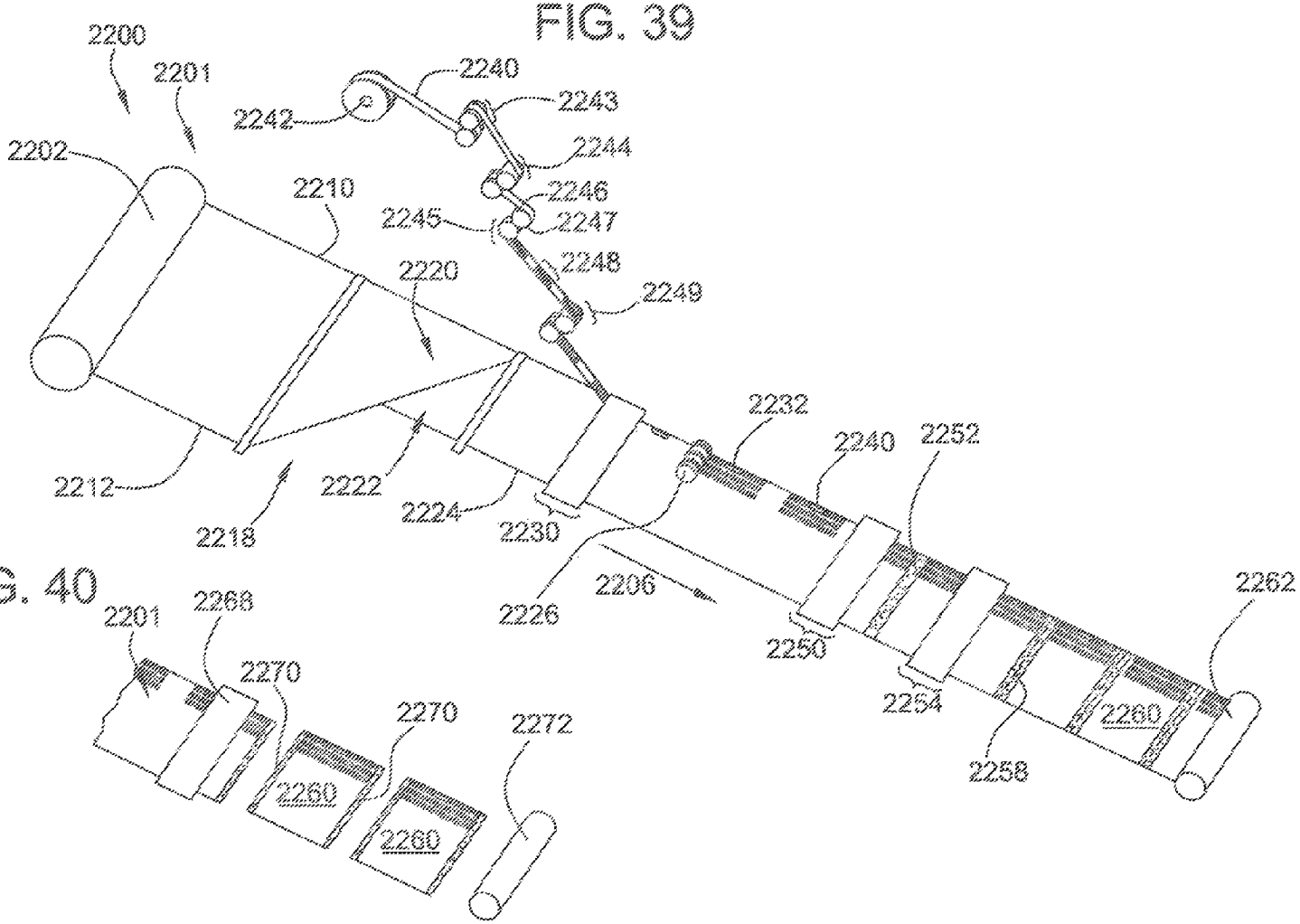
FIG. 39 is a schematic representation of another embodiment of the manufacturing process.
FIG. 40 is a schematic representation of some steps of another embodiment of the manufacturing process.

In another embodiment, rollers similar to rollers 1726 may be used, after the hemming operation, in order to impart a pattern to the hem and draw tape, and/or the bag side wall while the draw tape is in the hem, such as, the rollers 2226 in FIG. 39. These rollers may be used at any location after the hemming operation and before the web is separated into bags or rolled for consumer use. Thus, in this other embodiment, the rollers 1726 and rollers 1745 may not be necessary.

The web 1701 and strip 1740 may be directed through various other processing steps to produce the finished bag. For example, the web 1701 may be directed through a heat sealing operation 1750 in which heat seals 1752 are formed at intermittent spaces along the web between the adjacent edges 1710, 1712 and the folded crease 1724 so as to be perpendicular to the machine direction 1706. The heat sealing operation 1750 may melt together and thereby attach the two folded web halves and the strip 1740 within the region of the heat seal 1752. The heat seals 1752 may be performed while the strip 1740 is in the stretched state. The web 1701 may be directed through a perforating operation 1754 in which perforations 1758 are made between or into the heat seals 1752 between the adjacent edges 1710, 1712 and the crease 1724. The perforation may be disposed through both the folded web and strip 1740. As may be appreciated, the heat seals 1752 and perforations 1758 may correspond to the side edges of the finished bags 1760. To prevent the strip 1740 from unintentionally recovering and distorting the web 1701 advancing through the processing machinery, the web may be kept under tension along the machine direction 1706. In another embodiment, the web may be folded one or more times before the folded web may be directed through the perforating operation. The web 1701 embodying the finished bags 1760 may be wound into a roll 1762 for packaging and distribution.

In another embodiment of the process which is illustrated in FIG. 33, the web may be directed through a cutting operation 1768 which cuts the web at location 1770 into individual bags 1760 prior to winding onto a roll 1772. Cutting the bags 1760 from the web along location 1770 allows the draw tape to relax or contract and thereby constricts the top edges of the bag corresponding to the opening, as shown in FIG. 33, prior to winding into a roll 1772. The bags may be interleaved prior to winding into the roll 1772. In another embodiment, the web may be folded one or more times before the folded web is cut into individual bags.

Figure 34:
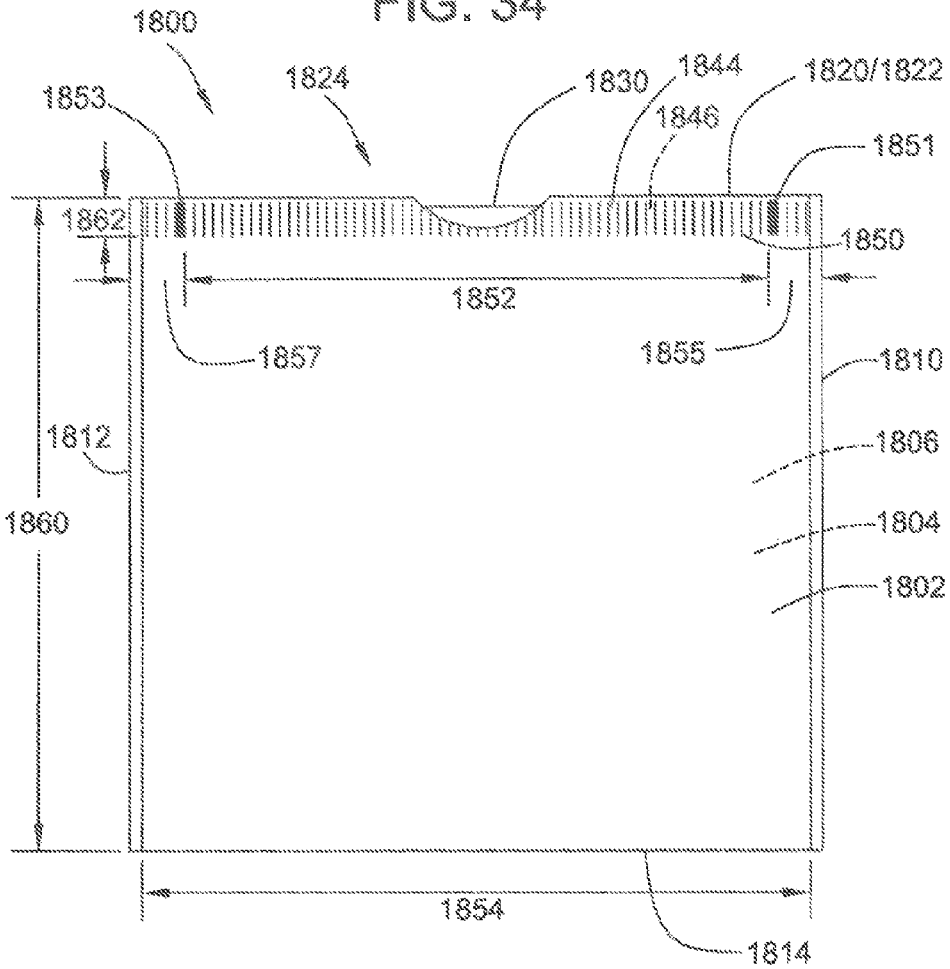
FIG. 34 is a front elevational view of another embodiment.

Referring to FIG. 34, there is illustrated another embodiment of a thermoplastic bag 1800 that may be used as a liner for a trash receptacle. The illustrated bag 1800 includes a first sidewall 1802 and a second sidewall 1804, both made of thermoplastic material, which are overlaid and joined to each other to define an interior volume 1806. The interior volume 1806 may be accessed via an opening 1824 delineated by the un-joined first and second top edges 1820, 1822 of the respective first and second sidewalls 1802, 1804. To cinch closed the opening 1824, the bag 1800 may include a draw tape 1830 that may be accommodated in hems 1844, 1846 formed proximate the opening.

The draw tape 1830 may be made from an elastic material. For example, the elastic material may be low density polyethylene, very low density polyethylene, ultra low density polyethylene, linear low density polyethylene, high density polyethylene, or ethylene vinyl acetate, and may be formed in combinations and in single or multiple layers. The draw tape may have elastic characteristics which allow the draw tape to stretch or extend when under tension and which allow the draw tape to relax or retract when not under tension. In another embodiment, the draw tape 1830 may be pre-stretched. For example, the draw tape 1830 may be prestretched as described with respect to draw tape 250 in FIGS. 8 and 9. The draw tape 1830 may have intermittent prestretching. For example, the draw tape 1830 may have intermittent prestretching as described with respect to draw tape 300 in FIGS. 10 and 11.

Inward seals 1851, 1853 may attach the draw tape 1830 to the hems 1844, 1846. In addition, the inward seals 1851, 1853 may attach the hems 1844, 1846 to each other. The draw tape 1830 is attached to hems 1844, 1846 when the draw tape 1830 is in a relaxed state. The inward seal 1851 may be located a distance 1855 from the side edge 1810 or side seal. The inward seal 1853 may be located a distance 1857 from the side edge 1812 or side seal. The distance 1855 may have a first range from about 0.25 inches (0.64 cm) to about 4 inches (10.2 cm), a second range from about 0.75 inches (1.91 cm) to about 3 inches (7.62 cm), and a third range from about 0.75 inches (1.91 cm) to about 1.75 inches (4.45 cm). In one embodiment, the distance 1855 may be about 1.25 inches (3.18 cm). The distance 1857 may be the same as distance 1855 or the distance 1857 may be different from the distance 1855.

The inward seals 1851, 1853 may reduce the size of the opening to a distance 1852. Other portions of the bag may have a distance 1854. The distance 1852 may be less than the distance 1854.

For example, when the bag 1800 is laid flat it may have a first distance 1854 as measured along the bottom edge 1814 from the first side edge 1810 to the second side edge 1812. Because the distance 1854 represents the front side of the bag, the perimeter at that location is twice the distance 1854 to account for the front side and the rear side of the bag. The distance 1854 may have a first range from about 8 inches (20.32 cm) to about 40 inches (101.6 cm), a second range from about 23 inches (58.42 cm) to about 31 inches (78.74 cm), and a third range from about 23 inches (58.42 cm) to about 25 inches (63.5 cm). In one embodiment, the distance 1854 may be about 24 inches (60.96 cm). Due to the inward seals 1851, 1853, the bag may have a second distance 1852 as measured along the top edges 1820, 1822 delineating the opening 1824. Because the distance 1852 represents the front side of the bag, the perimeter at that location is twice the distance 1852 to account for the front side and the rear side of the bag. The distance 1852 may have a first range from about 6.5 inches (16.51 cm) to about 38.5 inches (97.79 cm), a second range from about 20 inches (50.8 cm) to about 29 inches (73.66 cm), and a third range from about 20 inches (50.8 cm) to about 22 inches (55.88 cm). In one embodiment, the distance 1852 may be about 21.5 inches (54.61 cm). Thus, the second distance may be less than the first distance and the bag opening may be narrower at its top than at other portions of the bag.

Figure 35:
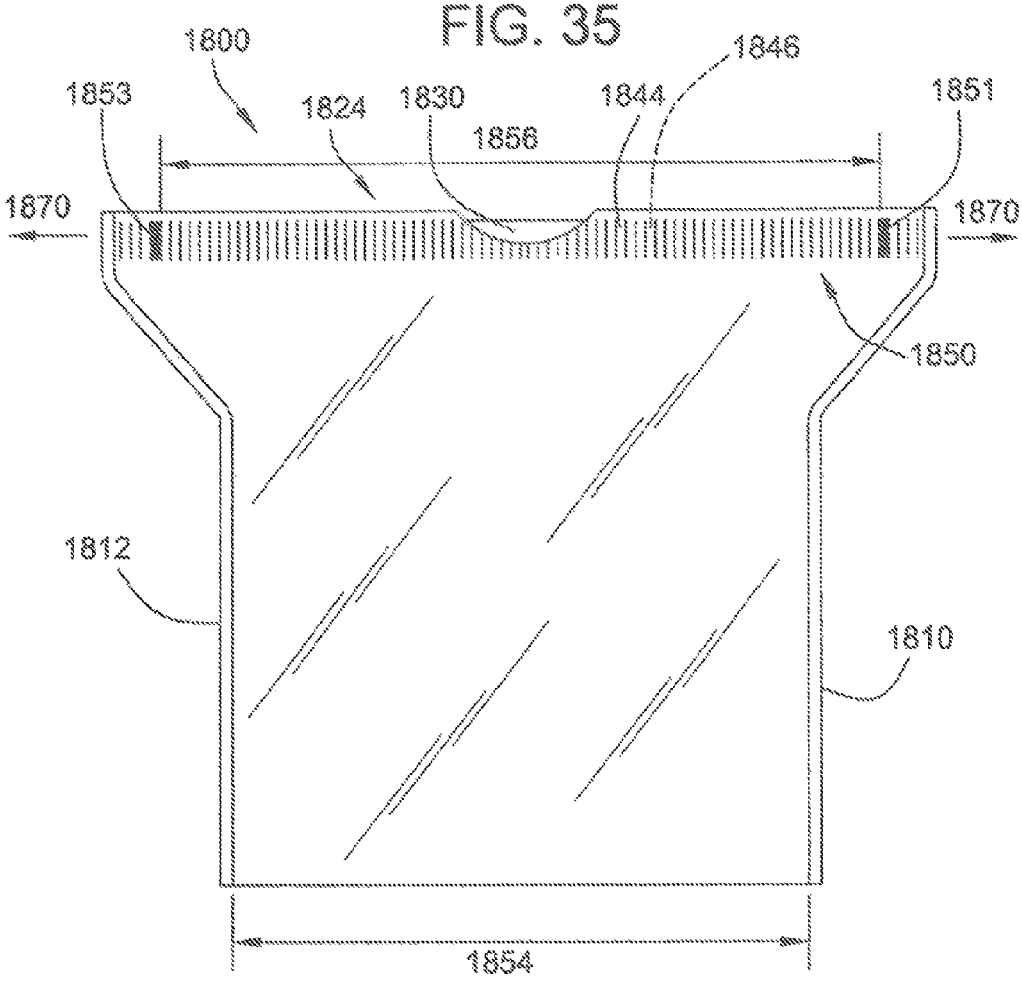
FIG. 35 is a front elevational view of the bag in FIG. 34 in a stretched condition.

The hems 1844, 1846 may be formed with a pattern 1850. The pattern 1850 may include a plurality of rib-like elements that protrude from the plane of the hems 1844, 1846. For example, the pattern 1850 may be similar to the pattern as described with respect to FIGS. 19 and 20. Referring to FIG. 35, because the pattern 1850 may provide a stretchable or yieldable characteristic, the pattern 1850 may, allow the opening 1824 to be stretched or widened. The opening 1824 may be stretched or widened during, for instance, installation of the bag 1800 onto a trash container. This feature not only enhances the ease of stretching the bag opening to match the width of the lower portions of the bag, but may enable the bag opening to stretch beyond the width of the lower portions of the bag to accommodate larger trash cans.

Referring to FIG. 35, the bag 1800 is shown in a stretched condition. Due to the stretchable characteristic of the pattern 1850, the hems 1844, 1846 may increase in length and thus, the size of the opening 1824 may increase. Also, due to the elastic quality of the draw tape material, the draw tape 1830 may be stretched or expanded to increase the size of the opening 1824. Because the draw tape 1830 for the most part may be loosely accommodated in the hems 1844, 1846, the draw tape 1830 may expand or stretch freely in the hems. For example, when a tensioning force 1870 is applied so as to pull the first and second side edges 1810, 1812 away from each other, the opening 1824 may increase in size to a distance 1856.

The distance 1856 may have a first range from about 6.6 inches (16.76 cm) to about 64.3 inches (163.32 cm), a second range from about 20 inches (50.8 cm) to about 46 inches (116.84 cm), and a third range from about 24 inches (60.96 cm) to about 40 inches (101.6 cm). In one embodiment, the distance 1856 may be about 30 inches (76.2 cm).

In one example, the width 856 may increase in size over width 1852 in a first range from about 1% to about 40%, a second range from about 5% to about 30%, and a third range from about 10% to about 25%. In one embodiment, the width 1856 may increase in size over width 852 by 23%. For example, the distance 1852 may be about 21.5 inches (54.61 cm) and the distance 1856 may have a first range from about 21.7 inches (55.12 cm) to about 30 inches (76.2 cm), a second range from about 24.5 inches (62.23 cm) to about 28 inches (71.12 cm), and a third range from about 25 inches (63.5 cm) to about 27 inches (68.58 cm). In one embodiment, the distance 1856 may be about 26.5 inches (67.31 cm). Thus, in one embodiment, the distance 1852 of 21.5 inches (54.61 cm) increased to the distance 1856 of 26.5 inches (67.31 cm).

In another example, the distance 1856 may increase in size over distance 1852 in a first range from about 1% to about 67%, a second range from about 7% to about 52%, and a third range from about 14% to about 48%. In one embodiment, the distance 1856 may increase in size over distance 1852 by about 30%. For example, the distance 1852 may be about 18 inches (45.72 cm) and the distance 1856 may have a first range from about 24 inches (60.96 cm) to about 30 inches (76.2 cm), a second range from about 24.5 inches (62.23 cm) to about 28 inches (71.12 cm), and a third range from about 25 inches (63.5 cm) to about 27 inches (68.58 cm). In one embodiment, the distance 1856 may be about 26.5 inches (67.31 cm). Thus, in one embodiment, the distance 1852 of 18 inches (45.72 cm) increased to the distance 1856 of 26.5 inches (67.31 cm).

In another example, a bag may achieve greater stretch by using one or more of the elastic materials described herein. For example, the distance 1856 may increase in size over distance 1852 in a first range from about 1% to about 150%, a second range from about 10% to about 133%, and a third range from about 25% to about 125%. In one embodiment, the distance 1856 may increase in size over distance 1852 by about 121%. For example, the distance 1852 may be about 12 inches (30.48 cm) and distance 1856 may have a first range from about 13 inches (33.02 cm) to about 30 inches (76.2 cm), a second range from about 18 inches (45.72 cm) to about 28 inches (71.12 cm), and a third range from about 24 inches (60.96 cm) to about 27 inches (68.58 cm) In one embodiment, the distance 1856 may be about 26.5 inches (67.31 cm).

These increases in the size of distance 1856 over distance 1852 may be achieved by using a force in a first range from about 1 lbf (4.48 N) to about 15 lbf (66.72 N), in a second range from about 2 lbf (8.9 N) to about 7 lbf (31.14 N), and in a third range from about 3 lbf (13.34 N) to about 5 lbf (22.24 N).

These increases in distance may apply to bags of all widths described herein, as appropriate.

The distance 1856 may be less than, equal to or greater than the distance 1854. For example, in one embodiment, the distance 1856 may be greater than distance 1854. In another embodiment, the distance 1856 may be the same as the distance 1854. In yet another embodiment, the distance 1856 may be less than the distance 1854.

When inserting the bag 1800 into a canister, the draw tape 1830 may be stretched and may be folded over the upper rim of the canister similar to FIG. 7. When the draw tape 1830 is released and contracts, the draw tape 1830 may cinch around and grip the outer periphery of the canister. This may help prevent the bag from falling into the canister, especially as trash and other refuse items are put into and collect within the lined canister.

Referring to FIG. 34, the bag 1800 may have a height 1860. The height 1860 may have a first range from about 8 inches (20.3 cm) to about 46 inches (116.8 cm), a second range from about 20 inches (50.8 cm) to about 30 inches (76.2 cm), and a third range from about 23 inches (58.4 cm) to about 26 inches (66.04 cm). In one embodiment, the height 1860 may be about 25.125 inches (63.82 cm). The pattern 1850 can extend from the top edges 1820, 1822 toward the bottom edge 1814 a distance 1862. The distance 1862 may have a first range from about 1 inch (2.54 cm) to about 10 inches (25.4 cm), a second range from about 2 inches (5.08 cm) to about 5 inches (12.7 cm), and a third range from about 2.5 inches (7.62 cm) to about 4 inches (10.16 cm). In one embodiment, the distance 1862 may be about 2.5 inches (9.194 cm), as appropriate.

In one embodiment, the pattern 1850 may be applied to the exterior of one or both of the hems 1844, 1846. In another embodiment, the pattern may be applied to the exterior and the interior of one or both of the hems. In another embodiment, the pattern may be applied to the interior of one or both of the hems, but the pattern would not be applied to the exterior of the hem. In other embodiments, the bag 1800 may include the pattern 850 shown in FIG. 21. In other embodiments, the pattern may be any of the patterns described herein, as appropriate.

Figure 18:
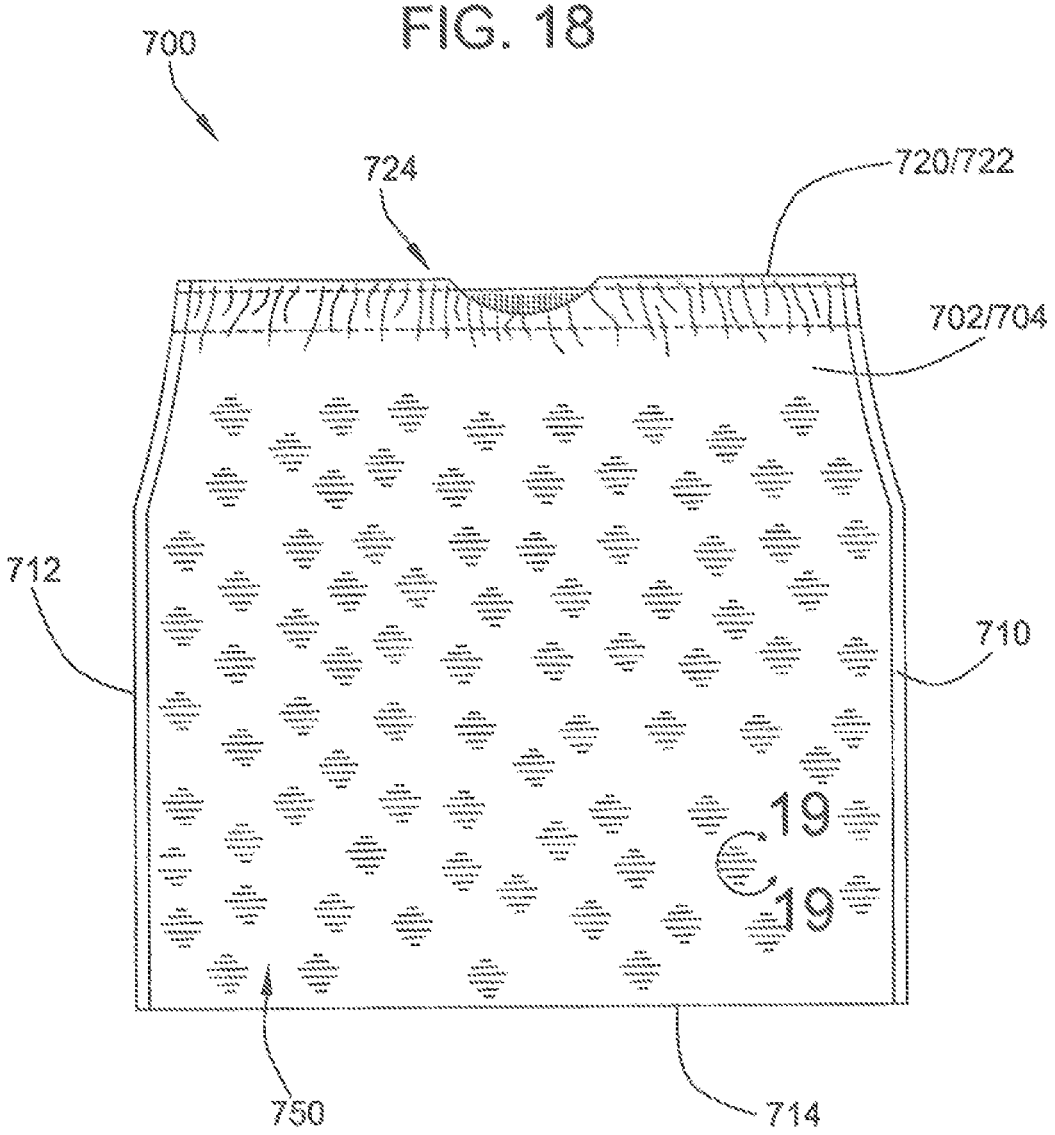
FIG. 18 is a front elevational view of another embodiment of a thermoplastic bag with a draw tape wherein the sidewall material is formed to have a stretchable or yieldable characteristic.

In another embodiment, the sidewalls may include a pattern similar to the pattern 750 in FIG. 18, or any other pattern described herein, as appropriate.

Figure 36:
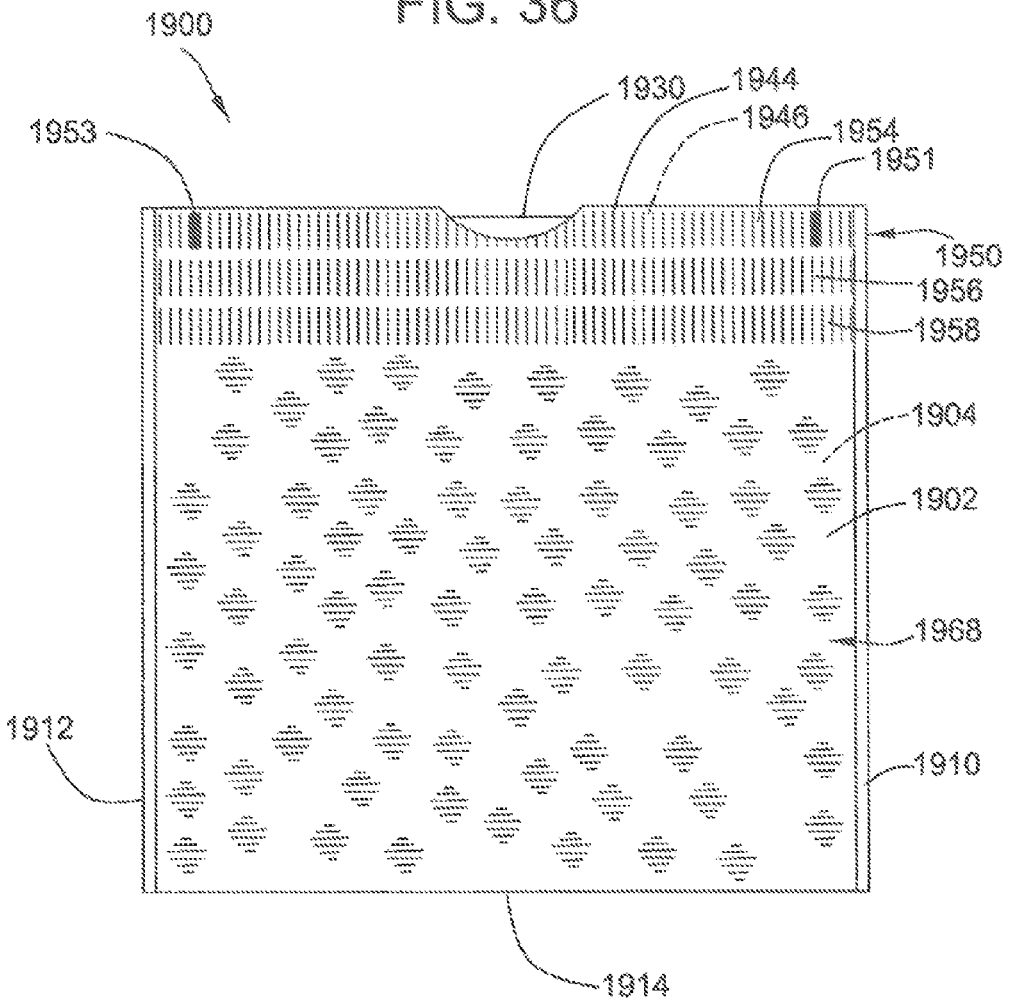
FIG. 36 is a front elevational view of another embodiment.

Referring to FIG. 36, there is illustrated another embodiment of a bag. The bag 1900 may be similar to bag 1800 in FIGS. 34 and 35 except for the pattern 1950 and the addition of a pattern 1968 for other portions of the bag 1900. The bag 1900 may include draw tape 1930, hems 1944, 1946, and inward seals 1951, 1953.

The pattern 1950 may be similar to the pattern 950 in FIG. 23. The pattern 1950 may include ribs. In this embodiment, the bag 1900 may include three rows 1954, 1956, 1958 of the ribs. In other embodiments, the bag may include one, two, four, five, six or more rows. The pattern 1950 may allow the opening of the bag to stretch. In one embodiment, the pattern 1950 may be applied to the exterior of one or both of the hems 1944, 1946. In another embodiment, the pattern 1950 may be applied to the exterior and the interior of one or both of the hems. In another embodiment, the pattern 1950 may be applied to the interior of one or both of the hems, but the pattern would not be applied to the exterior of the hem. In other embodiments, the bag 1900 may include the pattern 850 shown in FIG. 21. In other embodiments, the pattern may be any of the patterns described herein, as appropriate.

The pattern 1968 may be similar to pattern 750 in FIG. 18. Referring to FIG. 36, the pattern 1968 may be formed onto the thermoplastic first and/or second sidewalls 1902, 1904. The pattern 1968 may extend between the first and second side edges 1910, 1912 and from the bottom edge 1914 toward the pattern 1950. However, in other embodiments, the pattern 1968 may be formed over only select portions of the sidewall and in various designs. The pattern 1968 may provide the bag with a stretchable or yieldable characteristic. Examples of such patterns and similar features are described in U.S. Pat. No. 6,139,185; U.S. Publication No. 2004/0134923; U.S. Pat. No. 6,394,651; U.S. Pat. No. 6,394,652; U.S. Pat. No. 6,150,647; U.S. Pat. No. 6,513,975; and U.S. Pat. No. 6,695,476, each of which is herein incorporated by reference in its entirety and is set forth in its entirety herein.

The stretching of the draw tape 1930 and the upper portion of the bag 1900 may operate in a similar fashion as the bag 1800 in FIGS. 34 and 35. The bag 1900 may have similar dimensional information as the bag 1800 in FIGS. 34 and 35, or any other embodiment described herein, as appropriate.

Figure 37:
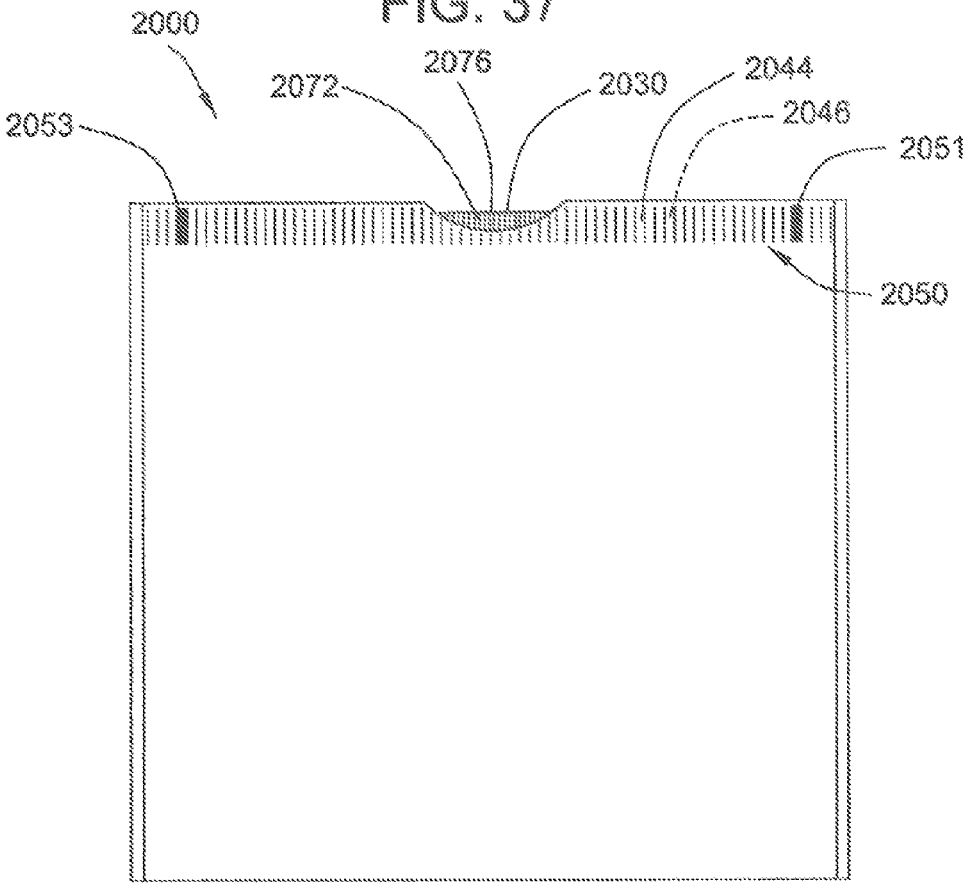
FIG. 37 is a front elevational view of another embodiment.

Referring to FIG. 37, there is illustrated another embodiment of a bag. The bag 2000 may be similar to bag 1800 in FIGS. 34 and 35 except for the draw tape 2030. The bag 2000 may include hems 2044, 2046 and inward seals 2051, 2053. The draw tape 2030 may have a pattern 2072. For example, the draw tape 2030 may be similar to the draw tape 470 in FIGS. 12-14. Referring to FIG. 37, the pattern 2072 may take the form of linearly arranged ribs 2076. The ribs 2076 may be parallel and adjacent to one another and perpendicular to the length of the draw tape such that the thermoplastic material has a generally corrugated or wavy shape with the ribs bunched closely together. However, when a tensioning force is applied to the pattern 2072 by, for example, pulling the draw tape, the ribs 2076 may unfold and the draw tape increases in length. Additionally, the draw tape 2030 may demonstrate shape memory or resiliency by which, when the tensioning force is released, the ribs 2076 reform or refold thereby causing the draw tape to contract. Thus, the pattern 2072 may provide the draw tape with an elastic quality. The pattern 2072 may operate in the same manner as the pattern 750 in FIGS. 19-20.

In other embodiments, the draw tape 2030 may have a variable width as in FIG. 15. In another embodiment, the draw tape 2030 may be prestretched and have a pattern 2072. The draw tape 2030 may have the same dimensional information as the draw tapes in FIGS. 12-15, or any other embodiment described herein, as appropriate.

In other embodiments, the pattern 2072 may be in other locations and/or the pattern 2072 may have a different size. In another embodiment, the draw tape 2030 may include a pattern along the entire length of the draw tape. In other embodiments, the ribs may be arranged in a different manner. For example, the ribs may be at an angle with respect to the length of the draw tape in a range from about 1 degree to about 90 degrees, such as, 30 degrees, 45 degrees, or 60 degrees. In another embodiment, the ribs may have different shapes, such as, arcs, chevrons, or waves.

In another embodiment, the sidewalls may include a pattern similar to the pattern 750 in FIG. 18, or any other pattern described herein, as appropriate.

The stretching of the draw tape 2030 may operate in a similar fashion as the draw tape 470 in FIGS. 12-14. The stretching of the upper portion of the bag 2000 may operate in a similar fashion as the bag 1800 in FIGS. 34 and 35. The bag 2000 may have similar dimensional information as the bag 1800 in FIGS. 34 and 35, or any other embodiment described herein, as appropriate.

Figure 38:
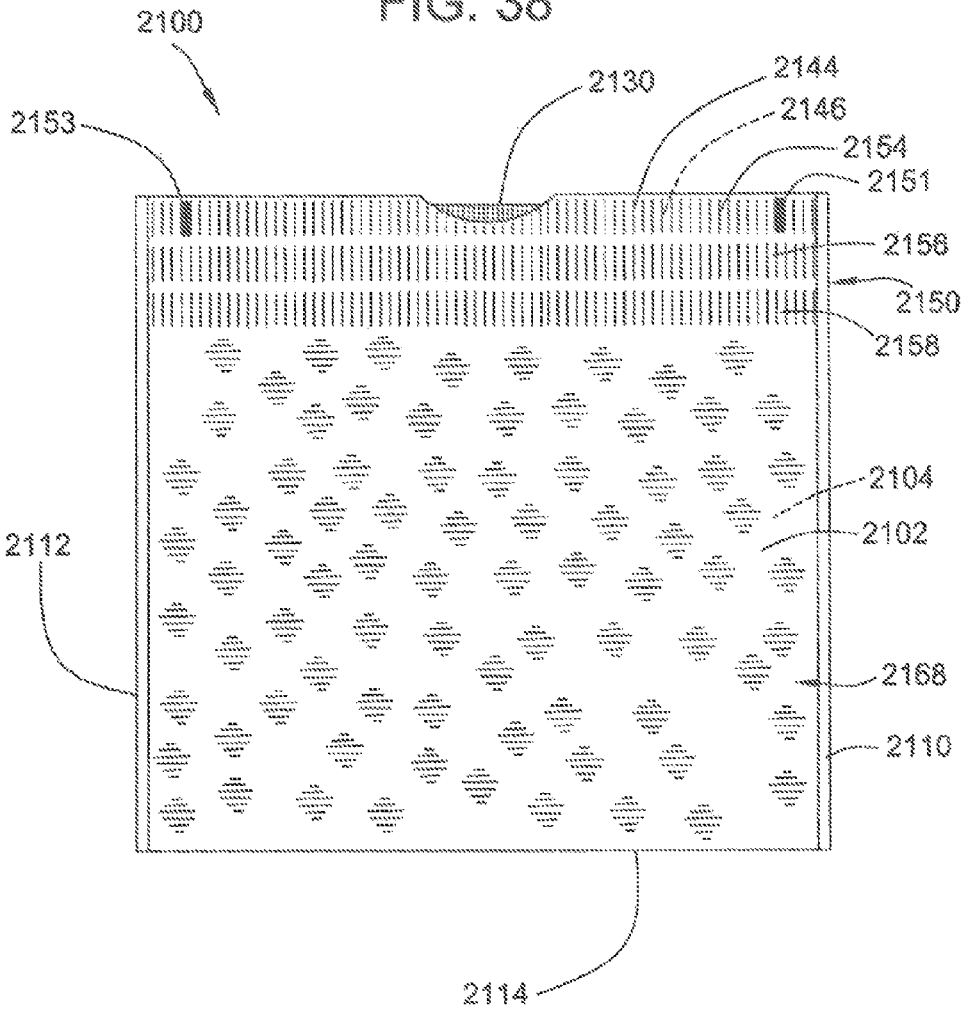
FIG. 38 is a front elevational view of another embodiment.

Referring to FIG. 38, there is illustrated another embodiment of a bag. The bag 2100 may be similar to bag 2000 in FIG. 37 except for the pattern 2150 and the addition of a pattern 2168 for other portions of the bag 2100. The bag 2100 may include draw tape 2130, hems 2144, 2146, and inward seals 2151, 2153.

The pattern 2150 may be similar to the pattern 950 in FIG. 23. The pattern 2150 may include ribs. In this embodiment, the bag 2100 may include three rows 2154, 2156, 2158 of the ribs. In other embodiments, the bag may include one, two, four, five, six or more rows. The pattern 2150 may allow the opening of the bag to stretch. In one embodiment, the pattern 2150 may be applied to the exterior of one or both of the hems 2144, 2146. In another embodiment, the pattern 2150 may be applied to the exterior and the interior of one or both of the hems. In another embodiment, the pattern 2150 may be applied to the interior of one or both of the hems, but the pattern would not be applied to the exterior of the hem. In other embodiments, the bag 2100 may include the pattern 850 shown in FIG. 21. In other embodiments, the pattern may be any of the patterns described herein, as appropriate.

The pattern 2168 may be similar to pattern 750 in FIG. 18. Referring to FIG. 38, the pattern 2168 may be formed onto the thermoplastic first and/or second sidewalls 2102, 2104. The pattern 2168 may extend between the first and second side edges 2110, 2112 and from the bottom edge 2114 toward the pattern 2150. However, in other embodiments, the pattern 2168 may be formed over only select portions of the sidewall and in various designs. The pattern 2168 may provide the bag with a stretchable or yieldable characteristic. Examples of such patterns and similar features are described in U.S. Pat. No. 6,139,185; U.S. Publication No. 2004/0134923; U.S. Pat. No. 6,394,651; U.S. Pat. No. 6,394,652; U.S. Pat. No. 6,150,647; U.S. Pat. No. 6,513,975; and U.S. Pat. No. 6,695,476, each of which is herein incorporated by reference in its entirety and is set forth in its entirety herein.

The stretching of the draw tape 2130 may operate in a similar manner as the draw tape 2030 in FIG. 37. The stretching of the upper portion of the bag 2100 may operate in a similar fashion as the bag 1800 in FIGS. 34 and 35. The bag 2100 may have similar dimensional information as the bag 1800 in FIGS. 34 and 35, or any other embodiment described herein, as appropriate.

The bags in FIGS. 34-38 may be made using a manufacturing process similar to the manufacturing process described with respect to FIGS. 31-33, as appropriate, except that the strip or draw tape may be in a relaxed condition during the sealing operation. The process may include the application of the inward seals during the sealing operation, or at another location in the process, as appropriate.

The bags in FIGS. 37-38 may be made using the manufacturing process 2200 shown in FIG. 39. The process 2200 may be similar to the process 1700 in FIG. 31 except that the rollers 2226 may be located after the hemming operation 2230 and that the strip or draw tape may be in a relaxed condition during the sealing operation.

Referring to FIG. 39, the web 2201 may be folded in half orthogonally about the machine direction 2206 by a folding operation 2218 so that the web may be arranged as first and second opposing, adjacent webs halves 2220, 2222 being advanced in parallel along the machine direction 2206. The web 2201 may provide a crease 2224 that may correspond to the bottom edge of the finished bag. In another embodiment, the roll 2202 may include a pre-folded web and the folding operation is not necessary. In another embodiment, a first web from a first roll and a second web from a second roll may be provided and advanced in parallel along the machine direction. The first and second webs may be joined along one edge to form the bottom portion of the bags.

The hems may be formed along the adjacent edges 2210, 2212 by a hemming operation 2230 in which hem flaps may be tucked and folded into the web 2201. A hem may be formed for each of the adjacent edges 2210, 2212. The hemming operation may add notches 2232.

To provide the draw tape, a continuous strip 2240 of thermoplastic thin-film material may be unwound from a roll 2242 of such material. The strip 2240 is directed by various rollers and/or nips toward the advancing web where it may be inserted into the hems.

The manufacturing process 2200 may include equipment to pre-stretch the strip 2240 prior to installation in the bag. The relative speed of the pairs of rollers 2243, 2244 may be adjusted to vary the amount and location of the pre-stretching induced onto the strip 2240. Another method of generating intermittent pre-stretching is shown in FIG. 32. In other embodiments, the roller 1734 in FIG. 32 may be moved by an air cylinder, hydraulic cylinder, eccentric connection, or other techniques.

Referring to FIG. 39, to impart the pattern 2248 into the strip, the processing equipment may include a pair of opposing rollers 2245 that may have intermeshing ridges 2246 and grooves 2247 formed on their surfaces. The surfaces of the opposing rollers 2245 may be configured so that the pattern 2248 is only imparted onto intermittent lengths of the strip 2240. A second pair of opposing rollers 2249 may be provided downward from the patterning rollers 2245 and may be rotated at a speed necessary to maintain the strip 2240 in a relaxed condition.

The strip 2240 may be in a relaxed state when the strip is inserted into the hem. A second roll of strip material may be similarly provided for insertion into the remaining hem of the two adjacent edges. It should be appreciated that in other embodiments of the manufacturing process, the order and/or presence of the hemming, notching and strip insertion operations may be altered or changed.

In another embodiment, the strip 2240 may not be stretched by rollers 2243, 2244, but may be processed by the rollers 2245 to receive the pattern 2248. The strip 2240 may be in a relaxed state when the strip is inserted into the hem.

Rollers 2226 may be used, after the hemming operation, in order to impart a pattern to the hem and draw tape, and/or the bag side wall while the draw tape is in the hem. These rollers may be used at any location after the hemming operation and before the web is separated into bags or rolled for consumer use. In another embodiment, the rollers 2245 with the pattern may not be necessary because the rollers 2226 may impart the pattern to the hem and strip at the same time.

The web 2201 and strip 2240 may be directed through various other processing steps to produce the finished bag. For example, the web 2201 may be directed through a heat sealing operation 2250 in which heat seals 2252 are formed at intermittent spaces along the web. The process may include the application of the inward seals during the sealing operation 2250, or at another location in the process, as appropriate.

The heat seals 2252 may be performed while the strip 2240 is in the relaxed state. The web 2201 may be directed through a perforating operation 2254 in which perforations 2258 are made between or into the heat seals 2252. The perforation may be disposed through both the folded web and strip 2240. As may be appreciated, the heat seals 2252 and perforations 2258 may correspond to the side edges of the finished bags 2260. In another embodiment, the web may be folded one or more times before the folded web may be directed through the perforating operation. The web 2201 embodying the finished bags 2260 may be wound into a roll 2262 for packaging and distribution.

In another embodiment of the process which is illustrated in FIG. 40, the web may be directed through a cutting operation 2268 which cuts the web at location 2270 into individual bags 2260 prior to winding onto a roll 2272. The bags may be interleaved prior to winding into the roll 2272. In another embodiment, the web may be folded one or more times before the folded web is cut into individual bags.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention. Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A drawstring comprising:

a stretched draw tape film comprising one or more of linear-low density polyethylene, low-density polyethylene, or high-density polyethylene; and the stretched draw tape film comprising an elastic characteristic that causes the stretched draw tape film to contract from a first length when in a relaxed state;

wherein the stretched draw tape film is made from an initial draw tape film of the first length subjected to a stretching process that provides the stretched draw tape film with the elastic characteristic;

wherein the stretched draw tape film has an elastic recovery that is greater than an elastic recovery of the initial draw tape film;

wherein the stretched draw tape film is devoid of a pattern of ribs that modify the elastic characteristic of the stretched draw tape film.

2. The drawstring of claim 1, wherein the stretched draw tape film has a tensile strength per square inch that is equal to a tensile strength per square inch of the initial draw tape film.

3. The drawstring of claim 1, wherein the stretched draw tape film has a tensile strength greater than a tensile strength of the initial draw tape film.

4. The drawstring of claim 1, wherein a load required to elongate the stretched draw tape film by 20 percent is 67 percent of a load required to elongate the initial draw tape film by 20 percent.

5. The drawstring of claim 1, wherein the stretched draw tape film comprises low-density polyethylene.

6. The drawstring of claim 5, wherein the stretched draw tape film comprises high-density polyethylene.

7. The drawstring of claim 1, wherein a width of the stretched draw tape film is less than a width of the initial draw tape film.

8. The drawstring of claim 1, wherein the stretched draw tape film comprises linear low-density polyethylene.

9. The drawstring of claim 1, wherein a width of the drawstring varies along a length of the drawstring.

10. The drawstring of claim 1, wherein the drawstring is positioned within a hem of a trash bag.

11. A drawstring comprising:

a stretched draw tape film comprising one or more of linear-low density polyethylene, low-density polyethylene, or high-density polyethylene, the stretched draw tape film being formed from an initial draw tape film; and an elastic characteristic provided by subjecting the initial draw tape film to a stretching process;

wherein the elastic characteristic provides the stretched draw tape film with elasticity such that a load required to elongate the stretched draw tape film by 20 percent is less than a load required to elongate the initial draw tape film by 20 percent;

wherein the stretched draw tape film is devoid of a pattern of ribs that modify the elastic characteristic of the stretched draw tape film.

12. The drawstring as recited in claim 11, wherein the stretched draw tape film has an elastic recovery that is greater than an elastic recovery of the initial draw tape film.

13. The drawstring of claim 11, wherein the elastic characteristic causes the stretched draw tape film to contract from a first length when in a relaxed state, the initial draw tape film having the first length.

14. The drawstring of claim 11, wherein the stretched draw tape film in a tensioned state has a width equal to 70 percent to 90 percent of a width of the stretched draw tape film in the relaxed state.

15. The drawstring of claim 13, wherein the stretched draw tape film in the tensioned state has a length equal to 112.5 percent of a length of the stretched draw tape film in the relaxed state.

16. The drawstring of claim 11, wherein the load required to elongate the stretched draw tape film by 20 percent is 67 percent of the load required to elongate the initial draw tape film.

17. The drawstring of claim 11, wherein the stretched draw tape film further comprising low density polyethylene.

18. The drawstring of claim 11, wherein the stretched draw tape film has a tensile strength per square inch that is equal to a tensile strength per square inch of the initial draw tape film.

19. The drawstring of claim 11, wherein the stretched draw tape film has a tensile strength greater than a tensile strength of the initial draw tape film.

20. The drawstring of claim 11, wherein the drawstring is positioned within a hem of a trash bag.

* * * * *